US011215421B1

(12) United States Patent
Coulombre

(10) Patent No.: US 11,215,421 B1
(45) **Date of Patent: *Jan. 4, 2022**

(54) GUN LOCK FOR A RAIL RISER

(71) Applicant: Overland Safety Systems, LLC, Framingham, MA (US)

(72) Inventor: Richard P. Coulombre, Medfield, MA (US)

(73) Assignee: Overland Safety Systems, LLC, Framingham, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/865,603

(22) Filed: May 4, 2020

Related U.S. Application Data

(63) Continuation-in-part of application No. 16/420,070, filed on May 22, 2019, now Pat. No. 10,641,575.

(51) Int. Cl.
*F41C 27/00* (2006.01)
*F41A 17/02* (2006.01)
*A47B 81/00* (2006.01)

(52) U.S. Cl.
CPC ..... *F41C 27/00* (2013.01); *A47B 81/005* (2013.01); *F41A 17/02* (2013.01)

(58) Field of Classification Search
CPC ..... F41A 17/00; F41A 17/02; F41A 17/04; A47B 81/005
USPC ..... 42/70.01, 70.11
See application file for complete search history.

(56) References Cited

U.S. PATENT DOCUMENTS 5,044,106 A 9/1991 Slocum
6,318,014 B1 11/2001 Porter
8,006,424 B1 8/2011 Ligard
D773,588 S 12/2016 Wasankari
D773,589 S 12/2016 Wasankari
D773,604 S 12/2016 Wasankari
9,708,835 B2 7/2017 Alan
D794,322 S 8/2017 Wasankari
10,641,575 B1 * 5/2020 Coulombre ..... A47F 5/0838
2009/0293334 A1 12/2009 Swan
2011/0173868 A1 7/2011 Wilson
2012/0014105 A1 1/2012 Jigamian
2013/0276343 A1 10/2013 Peters
2014/0252187 A1 9/2014 Petrovic
2015/0075054 A1 3/2015 Barger
2015/0260480 A1 9/2015 Dunn
2015/0377578 A1 12/2015 Tucker
(Continued)

OTHER PUBLICATIONS

Raptor Products, https://www.usaraptor.com, on or before Feb. 17, 2018.

*Primary Examiner* — Bret Hayes

(74) *Attorney, Agent, or Firm* — Loginov & Associates, PLLC; William A. Loginov

(57) ABSTRACT

A gun lock system for a rail riser can include a rail riser and a gun lock having a body that includes a slot sized to receive the rail riser and extending from a top surface of the body along a front surface to a stop located above a bottom surface with a channel extending from one side along the top to another and situated so as to be located above a top surface of a riser when placed into the slot. The shape profile of the body can describe an octagon or a circle. The channel can receive an inserted padlock shackle and prevent removal of a rail riser placed within the slot. When a padlock is inserted, the gun lock can hold an engaged rifle with rail riser and prevent removal.

20 Claims, 24 Drawing Sheets

(56) References Cited

U.S. PATENT DOCUMENTS

| | | | |
|---|---|---|---|
| 2018/0164078 | A1 | 6/2018 | Hancosky |
| 2019/0128470 | A1 | 5/2019 | Johnson, Sr. |
| 2019/0249949 | A1 | 8/2019 | Cahill |

* cited by examiner

GUN LOCK FOR A RAIL RISER

RELATED APPLICATION

This application is a continuation-in-part of co-pending U.S. patent application Ser. No. 16/420,070, entitled GUN LOCK FOR A RAIL RISER, filed May 22, 2019, which claims the benefit of U.S. Provisional Application Ser. No. 62/674,802, entitled GUN LOCK FOR A RAIL RISER, filed May 22, 2018, the entire disclosure of each of which applications is herein incorporated by reference.

FIELD OF THE INVENTION

The field of this invention relates to firearms locks and more particularly, to firearms locks that include a Picatinny rail attachment on a weapon.

BACKGROUND OF THE INVENTION

Traditional locking mechanisms for a firearm secure the firearm by restraining the stock or trigger guard to prevent removal or discharge of that firearm. Modern firearms can be provided with stocks and foregrips constructed of synthetic materials and/or wood components (that is to say, stock components). Modern firearms, such as the AR-15 family of weapons can include accessory mounts as part of the foregrips, or entire rail systems as a replacement to foregrips. Accessory mounts for weapons began with the development of the Weaver rail mount system that was the first standardized scope mount for rifles. The mount was improved in the 1980s and became the Picatinny rail system ("rail system"), a universal accessory system for military and paramilitary weapons. The Picatinny rail device has now relocated the fore grips on many military and paramilitary weapons systems. Today, one or more accessories can be mounted, including but not limited to tactical lights, laser aiming modules, night vision devices, reflex sights, fore grips, bipods and bayonets.

Picatinny rails and accessories can be incorporated into pistol frames and grips. Picatinny rail device locking slot dimensions have been standardized such that the slot width is 5.23 mm. The slot centers are spaced apart by 10.01 mm. Weaver rail mount system slots are less standardized, but have a uniform slot width of 4.57 mm. Accessories can be attached and detached by sliding them onto the rail from one end or the other, by clamping with bolts, thumbscrews or levers; or onto the slots between the raised sections or the rails.

It would be desirable to provide a mounting device that can retain a firearm for ready access and that can also be secured with a commonly available padlock, cotter pin, clevis pin or the like to create a gun lock.

SUMMARY OF THE INVENTION

The gun lock system provided herein overcomes disadvantages of the prior art by providing a weapon securing system that can be bolted to a wall or other structure, and can quickly and easily secure and release a weapon. The gun lock system can include a lock body with a slot, and a weapon with an attached rail riser, so that the rail riser can be slid within the slot and locked into place.

In an illustrative embodiment, a gun lock system can have a lock body, the lock body having a slot extending inward from an edge surface of the lock body along a front surface of the lock body, the slot having floor, a rear wall, and two sidewalls, the sidewalls having a side groove, and the lock body having a channel extending through the lock body and through the slot. The lock body can have at least one mounting bolt hole, the mounting bolt hole having a first opening on the rear wall of the slot and a second opening on a rear surface of the body. The sidewalls can have a shoulder on each sidewall, the groove extending along the sidewalls. The channel can be sized and shaped to accommodate a shackle of a padlock. The gun lock system can include a rail riser having an elevated rail, and the slot can be sized and shaped to accommodate the elevated rail. The slot has an angled "V" portion at an opening at the edge.

In an illustrative embodiment, a gun lock system can have a rail riser with an elevated rail and a lock body. The lock body can have a slot extending inward from an edge surface of the lock body along a front surface of the lock body, and the slot can be sized and shaped to accommodate the elevated rail. The slot can have a floor, a rear wall, and two sidewalls, and the sidewalls can have a side groove. The lock body can have a channel extending through the lock body and through the slot. A distance from the floor to the channel can be at least as long as a length of the elevated rail, so that the rail can fit within the slot without obstructing the channel. The channel can be sized and shaped to accommodate a shackle of a padlock. When the elevated rail within the slot, a shackle of a padlock can be inserted through the channel and can retain the elevated rail within the slot. The gun lock system can include a padlock. The lock body can include at least one mounting bolt hole, and the mounting bolt hole can have a first opening on a rear wall of the slot and a second opening on a rear surface of the body, so that when the rail riser is within the slot, the rail riser covers the opening on the rear wall of the slot. A mounting bolt within the mounting bolt hole cannot be removed when the elevated rail is within the slot. The rail riser can include at least one rail bolt hole through the rail riser, the rail bolt hole having an opening on the elevated rail of the rail riser, wherein when the elevated rail is within the slot, the lock body covers the opening on the elevated rail. When a rail bolt is within the rail bolt hole and securing the rail riser to a weapon, the rail bolt cannot be removed when the elevated rail is within the slot. The sidewalls can include a shoulder extending along the sidewalls. The slot can have an angled "V" portion at an opening at the edge. The rail riser defines a central well, the central well having a retaining lip.

In an illustrative embodiment, a method of securing a weapon having a weapon rail can include obtaining a rail riser having an elevated rail and affixing the rail riser to the weapon rail. The method can include obtaining a lock body, the lock body having a slot extending down from a top surface of the lock body along a front surface of the lock body, the slot having floor, a rear wall, and two sidewalls, the sidewalls having a side groove, and the lock body having a channel extending through the lock body and through the slot, and the lock body having at least one mounting bolt hole, the mounting bolt hole having a first opening on the rear wall of the slot and a second opening on a rear surface of the body, and securing the lock body to a wall by inserting a bolt through the mounting bolt hold and into a wall. The method can include sliding the elevated rail into the slot, whereby the rail riser covers and protects the mounting bolt and prevents removal of the mounting bolt so that the lock body cannot be unbolted from the wall. The method can include obtaining a padlock with a shackle, inserting the shackle through the channel so that the shackle is above the elevated rail and prevents the elevated rail from sliding out of the slot, and locking the padlock, thereby preventing the rail riser from being removed from the slot. The method can further include securing the rail riser to the rail of the weapon by inserting a bolt through an opening on the elevated rail and through a rail bolt hole of the rail riser and into a space between segments of the weapon rail.

BRIEF DESCRIPTION OF THE DRAWINGS

The invention description below refers to the accompanying drawings, of which.

DETAILED DESCRIPTION

Figure 1:
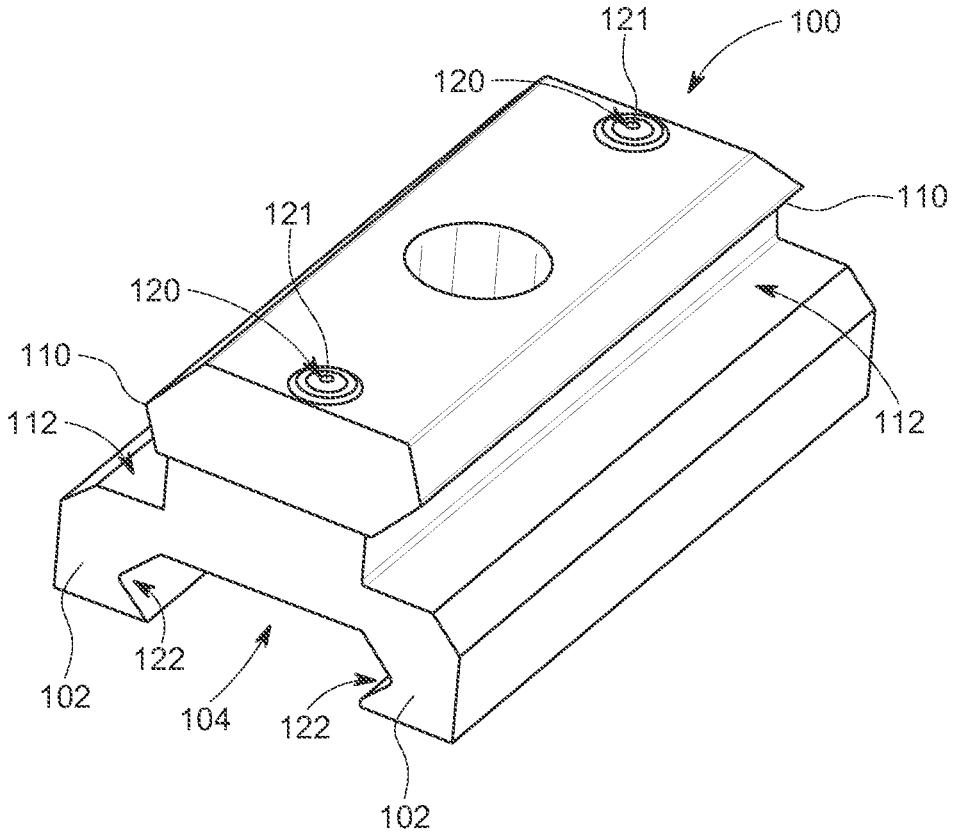
FIG. 1 is perspective view of an exemplary rail riser, according to an illustrative embodiment.

FIG. 1 depicts a rail riser. As defined herein, a rail riser 100 is an accessory that can be attached to one of a rail of a firearms rail system. A rail riser 100 can slide onto an existing rail on a weapon, and can include an elevated second rail segment. The rail riser 100 is provided with rail holders 102 and a main channel groove 104 for engaging the rail system on a weapon. Top shoulders 110 and adjacent grooves 112 can be inserted into a locking mechanism (not shown). The rail riser 100 can be removably attached to a firearm and can be used in turn to attach the firearm to a locking mechanism. The rail riser is proportioned and dimensioned to readily attach to a firearm rail system. The rail riser 100 can be attached to a firearm rail system by one or more bolts 121 that are inserted through the rail riser via through holes 120 that can be threaded. The one or more bolts 121 can be inserted through holes 120 into a space between segments of the rail. Side grooves 122 that are within the main channel groove 104 engage the weapon's rail on either side and prevent lateral rotation or movement of the rail riser. This function of the side grooves 122 in combination with one or more bolts inserted down the through holes 120 into the gaps in the rail secures the rail riser to the rail.

Figure 2:
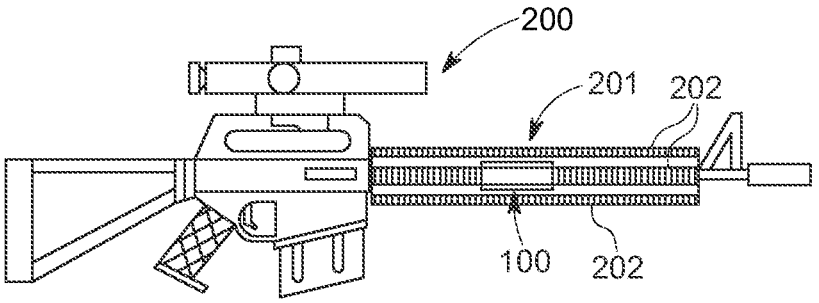
FIG. 2 is a view of a firearms system with a rail system, according to the illustrative embodiment.

FIG. 2 depicts a rail riser 100 attached to a foregrip 201 of a rifle 200 of the AR-15 family of firearms. As noted above, the rail riser 100 can be attached to one of a plurality of rail systems 202. As shown in FIG. 2, the illustrative rail riser 100 is attached to a rail extending along a side of the foregrip 201. A firearms system provided with a rail system and a rail riser 100 can be attached to a mounting device that can be mounted onto a wall or other vertical or non-vertical support member, or onto or inside a vehicle, and the mounting system can inter-engage with a rail riser system and removably secure the weapon to the mounting system.

Figure 3:
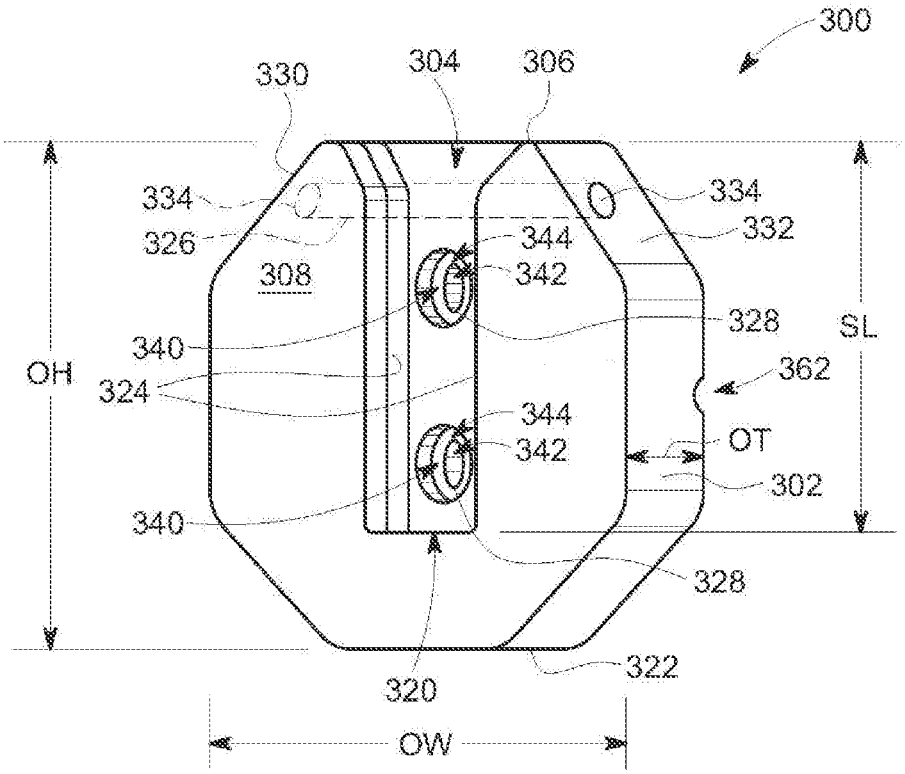
FIG. 3 is a perspective view of a gun lock for a rail riser, according to a first illustrative embodiment.

FIG. 3 is a perspective view of a gun lock 300 for a rail riser. The gun lock system can include a rail riser and a gun lock 300. A gun lock 300 can have a body 302 that includes a slot 304 sized to receive the rail riser 200, so that the elevated second rail segment of the rail riser can be slid into the slot 304. Slot 304 can extend from a top surface 306 of the body 302 along a front surface 308 to a stop 320 located above a bottom surface 322. The body 302 can also have a channel 326 extending through an upper region of the body 302 from one side to another so that the channel 326 passes through an upper region of the slot 304. The channel 326 can be situated so as to be located above a top surface of a riser when the riser is placed into the slot. The channel 326 can accommodate a padlock, cotter pin, clevis pin or the like. The shape profile of the body 302 can be an octagon, a circle, or other shapes. A padlock shackle can be inserted into the channel 326 to prevent removal of a rail riser that has been placed within the slot. Because the bolt holes 120 and bolts 121 are located on the elevated second rail of the rail riser, when the rail riser is held within the slot 304 the bolts are not exposed and cannot be removed from the rail riser, and so the rail riser cannot be removed from the weapon. The rail riser cannot be removed from the weapon until the rail riser is removed from the slot and the bolts are exposed.

When a shackle of a padlock is inserted into the channel 326, the gun lock can hold an engaged weapon with rail riser and prevent removal of the weapon until the padlock is unlocked and removed. The gun lock system can include a rail riser 100 that is attached to a rifle 200, a wall mounted gun lock 300 and an optional padlock 1200. The gun lock body 302 as shown can be, by way of non-limiting example, an octagonal shape in profile and is provided with a slot 304 that opens to a top surface 306 that is sized and dimensioned as to length, width and depth to receive and retain a rail riser (not shown). Slot 304 is the receiving slot for the rail riser 100. In an embodiment, the overall height OH of the gun lock 300 can be approximately 3 inches (±0.5 inches) and the overall width OW can be approximately 3 inches (±0.5 inches). The overall thickness OT can be approximately 1 inch (+0.25 inches). It is expressly contemplated that the thickness of the gun lock body can be greater as desired, for instance, to accommodate a rifle with large diameter optics or a weapon of unusual shape and dimensions. In the case of a thicker gun lock body, the size and depth of the slot 304 and the position of the channel 326 relative to the front surface 308 can remain the same as that of the described thickness. A front surface 308 can be relatively flat in profile to avoid any obstruction to an engaged firearm in the gun lock. It is contemplated that the flat front surface 308 can be inscribed with inset lettering for a brand name, instructive language or the like, and that the exterior surface can be color coated (for example, with red paint) to indicate the location of the gun lock along a wall surface. It is further contemplated that given a situation wherein a plurality of gun locks are mounted to a common wall that various gun lock bodies can be color coded according to a user or a particular padlock and key. The slot 304 can extend from the top surface 306 along the body 302 to a stop 320 that is located above the bottom surface 322. In an embodiment, the length of the slot SL can be approximately 2.5 inches (±0.25 inches). Slot 304 can be provided with a pair of counterpoised slot shoulders 324, a through channel 326 and at least one mounting socket 328. Counterpoised slot shoulders 324 can slide within the grooves 112 of the rail riser 100 to help secure the rail riser 100 within the slot 304. Slot shoulders 324 can engage with the shoulders 100 and grooves 112 of the rail riser to prevent the riser from being pulled out from the front face of the gun lock 300. In an embodiment, the gun lock 300 can be provided with two mounting sockets 328. It is contemplated that more than two mounting sockets can be provided. The top channel 326 can extend from a left side upper facet 330 to a right side upper facet 332 and can be accessible by holes 334 in the related upper facet. Holes 334 are sized and dimensioned to accommodate the shackle of a padlock, as will be described more fully below.

A body 302 can also have a locking cable passage 362 that can be sized and shaped to accommodate a locking cable. By way of non-limiting examples, a locking cable passage 362 can be a tunnel or can be an open furrow in the back face of the body 302 that can extend from a left side to a right side of the body 302. In an embodiment, passage 362 can be in the shape of a semi-cylinder, having a semi-circular profile. In an embodiment, one mounting socket 328 can be above the passage, and one mounting socket 328 can be below the cable passage, so that a locking cable can be held between bolts within the mounting sockets.

Mounting holes 328 can be stepped such that an outer hole 340 is drilled into the body 300 with a given diameter and an inner hole 342, of a narrower diameter than that of the outer hole is centered and drilled within the outer hole, creating a shoulder 344 such that a screw or bolt that is inserted into the inner hole will rest within the outer hole, and the head of that bolt will confront the shoulder 344 and securely hold the gun lock 300 to the wall (or other underlying attachment surface). Because the mounting holes 328 are within the slot 304, the body mounting bolts and bolt holes 328 are covered by the rail riser when the rail riser is within the slot 304, and the body mounting bolts cannot be removed from the body 302 until the rail riser is removed from the slot 304, thereby exposing the body mounting bolts and bolt holes 328. Channel 326 extends across the top of slot 304 and is set within the slot so as not to obstruct the insertion, retention and removal of a rail riser in the slot. When a padlock shackle is inserted into the channel 326 and above a rail riser within the slot 304, the padlock shackle prevents removal of the rail riser from the slot, which then also prevents removal of the riser bolts from the riser and prevents removal of the riser from the weapon, and prevents removal of the body mounting bolts from the body and prevents removal of the lock body from the wall or other mounting surface. The gun lock 300 can be free of moving parts, and can be formed of a cast metal, for example, a zinc alloy, an aluminum alloy or another lightweight metal alloy, or a synthetic polymer, a ceramic, a fiber (glass, nylon, carbon, etc.), or a combination thereof. The overall weight of the gun lock will depend on the material used in it construction.

Top surface 306 can be a flat surface perpendicular to the orientation of slot 304, can be angled downwards on both sides towards the slot to guide the rail riser into the slot 304, or can have flat portions on either side of a downwardly angled "V" portion above the slot (as shown in FIG. 3), or other possible shapes. A flat top surface can provide for placement of a spirit level during the mounting of the gun lock to a wall surface for alignment purposes if the user desires that the slot 304 is mounted in an up and down orientation so that a rifle placed into the lock will be urged by gravity to slide down the slot to the stop 320.

Figure 4:
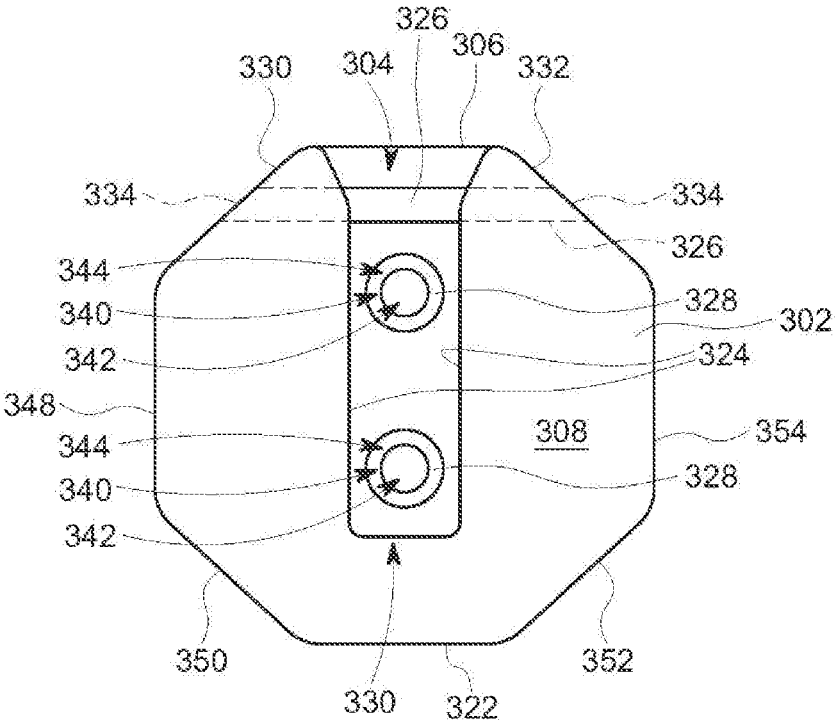
FIG. 4 is a front view of a gun lock for a rail riser, according to the first illustrative embodiment.

FIG. 4 is a front view of gun lock 300. As shown herein, the gun lock 300 can be octagonal in profile and can be provided with a top surface 306 and a bottom surface 322, a left upper facet surface 330, a right upper facet surface 332, a left side surface 348, a left lower facet surface 350, a right lower facet surface 352 and a right side surface 354.

Figure 5:
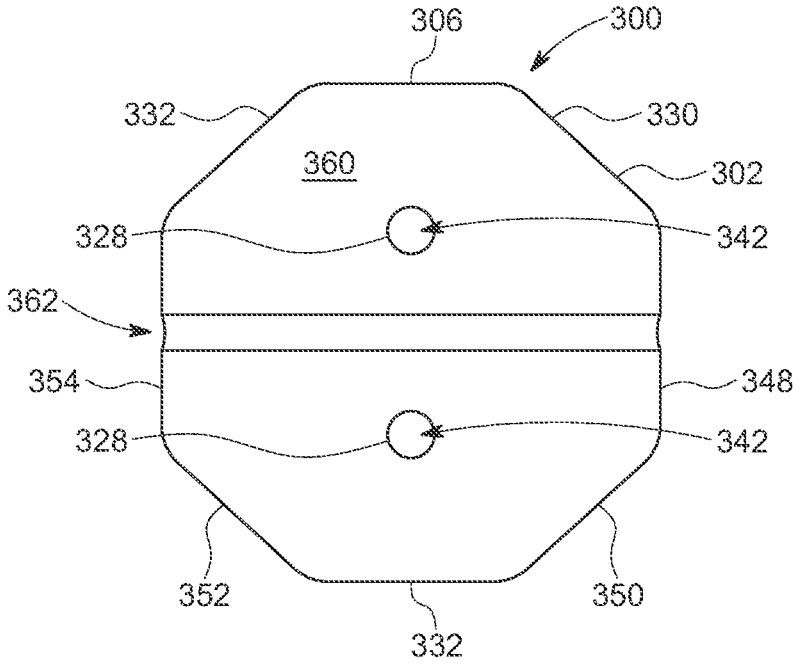
FIG. 5 is a rear view of a gun lock for a rail riser, according to the first illustrative embodiment.

FIG. 5 is a rear view of a gun lock 300. Gun lock 300 can have a flat rear surface 360 with two perforations that are holes 342 for mounting screws. Gun lock 300 can have a passage 362 from the left side to the right side. Passage 362 can be semi-cylindrical or other shapes. Passage 362 can pass between the holes 342. A user can secure a locking cable within the passage 362, so that the locking cable can be used to secure a firearm. The locking cable can be secured between the body 302 and the wall that the body 302 is mounted to, and between the bolts that pass through holes 342 and into the wall. While rear surface 360 is shown as being smooth, it is contemplated that the surface could be provided with a texture to enhance the gripping qualities of an adhesive if desired.

Figure 6:
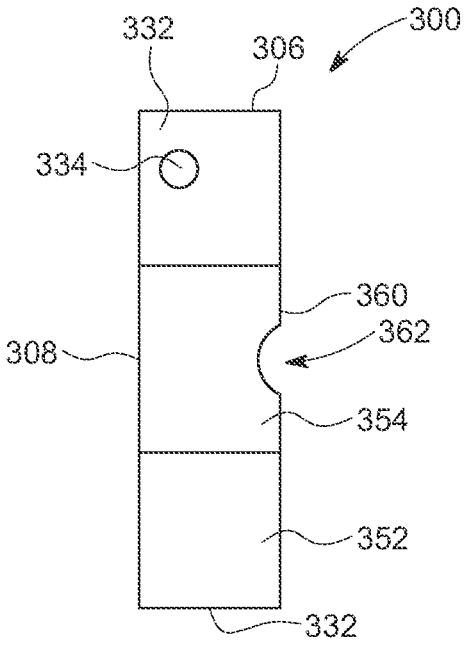
FIG. 6 is a first side view of a gun lock for a rail riser, according to the first illustrative embodiment.

FIG. 6 is a first side view of gun lock 300 showing the details and surfaces of the right side of the gun lock. Hole 334 can be centered, or can be off-center and closer to the front surface 308 than the rear surface 360. Passage 362 can be centered or off center, and can be a closed tunnel, or can be a semi-cylindrical furrow or other shapes.

Figure 7:
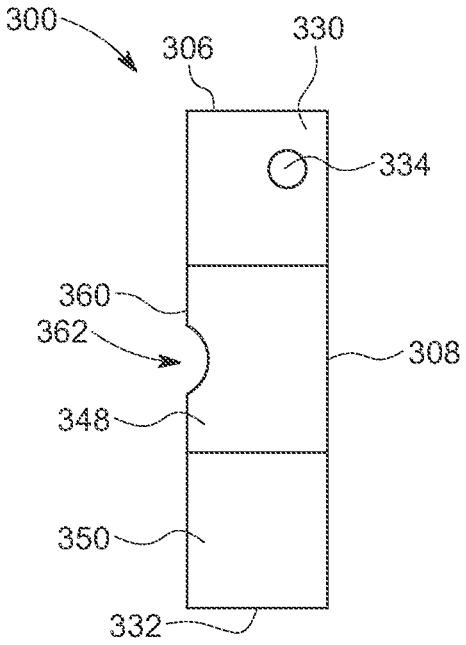
FIG. 7 is a second side view of a gun lock for a rail riser, according to the first illustrative embodiment.

FIG. 7 is a second side view of gun lock 300 showing the details and surfaces of the left side of the gun lock. As noted above, hole 334 can be centered or can be off-center and closer to the front surface 308 than the rear surface 360. Passage 362 can be centered or off center, and can be a closed tunnel, or can be a semi-cylindrical furrow or other shapes.

Figure 8:
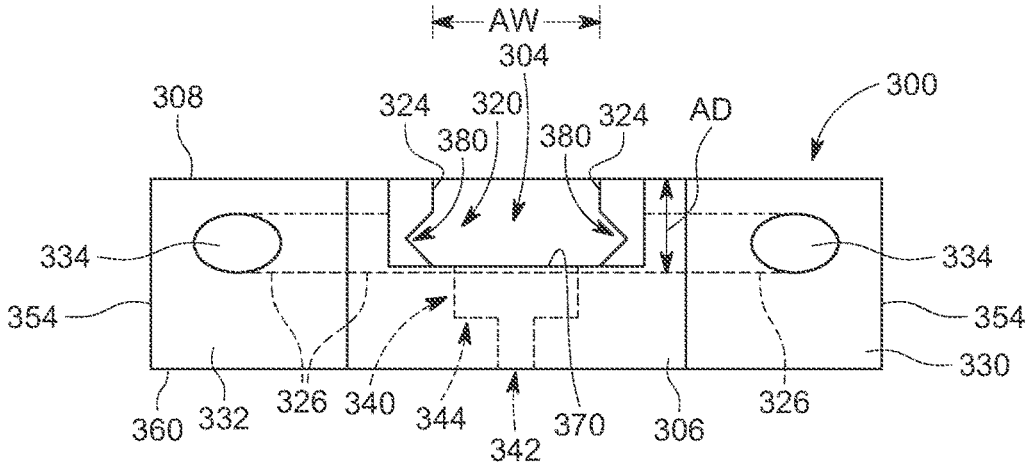
FIG. 8 is a top view of a gun lock for a rail riser, according to the first illustrative embodiment.

FIG. 8 is a top view of gun lock 300. In an embodiment, rear wall 370 of slot 304 may not be located as close to the rear surface 360 as the channel 326, so that a portion of the channel 326 may be seen along the rear wall 370. Because the channel 326 can be partially inscribed within the rear wall 370, a padlock shackle can be at least partially protected by the rear wall 370, thereby preventing a prying tool from being slid behind the shackle, preventing a cutting tool from accessing and cutting the entire shackle within the lock body, etc. Side grooves 380 in slot 304 function with regard to the elevated second rail of an inserted rail riser in the same manner that the side grooves 122 (described above) of the rail riser function with respect to the rail of the weapon. The side grooves 380 accommodate the insertion of top shoulders 110 (described above) and prevent lateral rotation and movement of the rail riser when engaged in the slot 304. When top shoulders 110 are slid within the side grooves 380, the engagement of the top shoulders 110 within the grooves 380 prevents the rail riser from being pulled out through the front face 308 of the lock body 300. The slot width AW can be approximately 0.690 inch (+0.25 inches). The slot depth AD can be approximately 0.230 inch (+0.25 inches).

Figure 9:
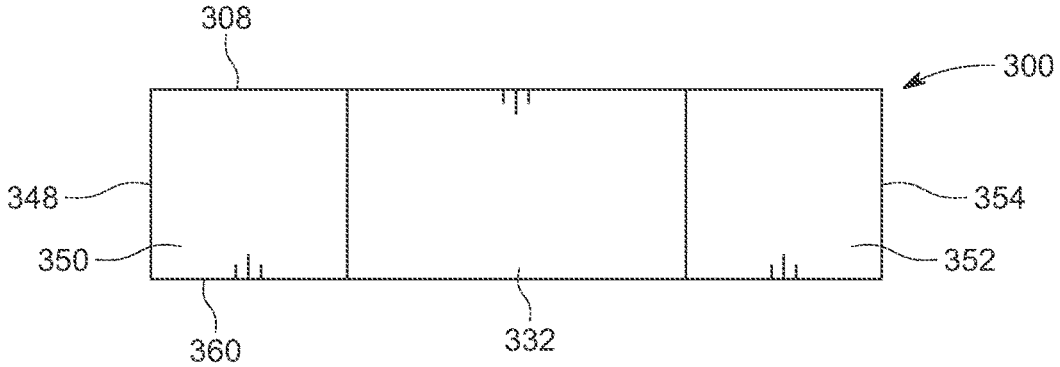
FIG. 9 is a bottom view of a gun lock for a rail riser, according to the first illustrative embodiment.

FIG. 9 is a bottom view of a gun lock 300. The slot 304 does not extend to the bottom surface 332 and an inserted riser rests on stop 320 (shown above in FIG. 8).

Figure 10:
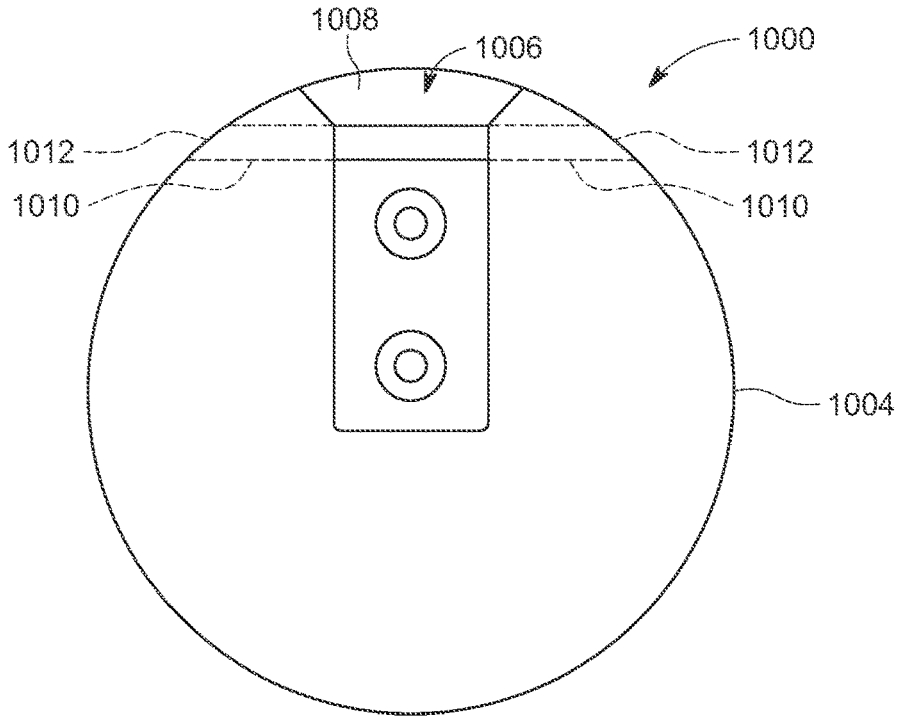
FIG. 10 is a perspective view of a gun lock for a rail riser, according to a second embodiment.

FIG. 10 is a view of a gun lock 300, according to an alternative embodiment wherein the profile of the body 1002 can be round and the perimeter surface 1004 can include a slot 1006 that can be located at the top 1008. Slot 1006 can function as the slot 304 described above. A channel 1010 with holes 1012 for receiving a padlock is provided in the same manner as the channel 326 described above.

Figure 11:
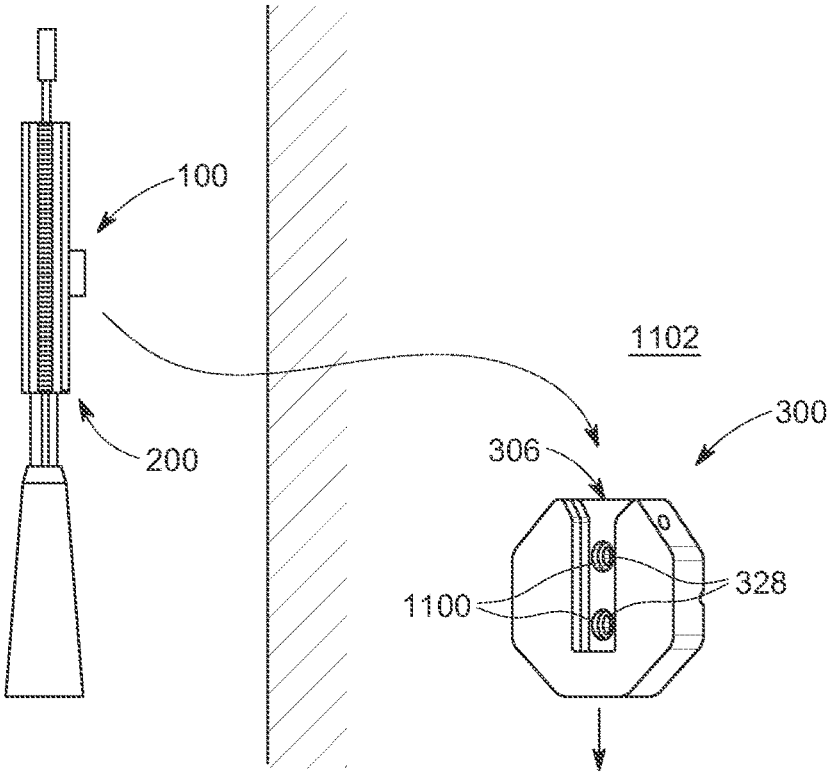
FIG. 11 is a perspective view of a firearms system with attached rail riser engaging a wall mounted gun lock for a rail riser, according to an illustrative embodiment.

FIG. 11 is a first view of a rifle 200 with attached rail riser 100 engaging a wall mounted gun lock 300. In an embodiment, the gun lock 300 can be bolted to the wall by bolts 1100 inserted into the mounting holes 328 that are in turn fixed into the structure of a wall 1102. Slot 304 can be oriented such that it is at the top of the gun lock. In a first step for securing a firearm to the gun lock 300, a rifle 200 is aligned at the top of the slot 304. Gravity can assist the rail riser 100 in travelling in a downward motion within the slot 306 until the bottom of the rail riser comes into contact with the stop 320. It should be noted that the locking of the rail riser to the rail by bolts inserted into through holes 122, as noted above, provides addition security as the heads of the bolts are not accessible when the rifle is placed into the wall mounted gun lock. The rifle is now attached to the gun lock, as shown in FIG. 12.

Figure 12:
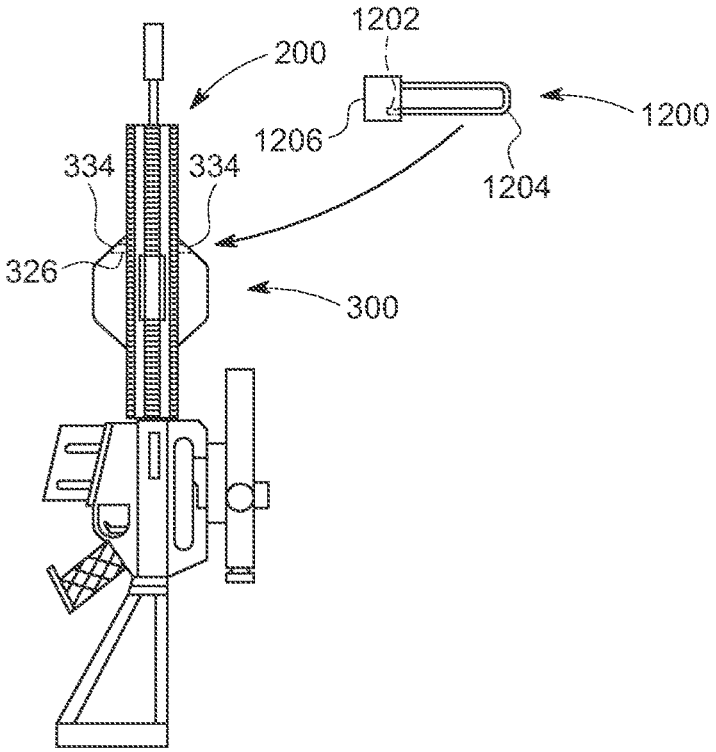
FIG. 12 is a front view of a firearms system with attached rail riser engaged within a wall mounted gun lock for a rail riser, according to the illustrative embodiment.

FIG. 12 is a front view of a firearms system with attached rail riser engaged within a wall mounted gun lock for a rail riser, according to the illustrative embodiment. A second step for securing a firearm to the gun lock 300 is shown in FIG. 12. With the rifle 200 engaged in gun lock 300, a padlock 1200 in an open configuration can be positioned such that an end 1202 of the open shackle 1204 can be inserted into hole 334. A padlock is optional and if a padlock is not placed into the gun lock, the gun lock functions as a gun holder. Using a padlock converts the gun lock into a locking system. The padlock adds security to the gun lock by trapping the riser 100 (with an attached rifle) within the slot 304 between a padlock shackle in the channel 326 and stop 320. It is contemplated that the padlock shackle 1204 can be inserted into the gun lock 300 at a hole 334 from either one of a left side or a right side. The padlock shackle 1204 is then drawn through the channel 326 and passes out the corresponding hole 334 on the opposite side from the entry hole. The padlock 1200 can then be manipulated into a closed and locked orientation, thereby securing the rifle 200 in the gun lock 300 until the padlock is unlocked and opened. As described herein, a padlock can be in either one of two configurations, open or closed. The open configuration can be described as the shackle end 1202 outside the locking body 1206 such that the shackle 1204 is free to rotate. In the closed configuration, the shackle end 1202 is secured within the locking body 1206 and the shackle 1204 is fixed in place and non-rotatable. It should be noted that the length of the slot 304 is greater than the length of the rail riser 100 and that the top of the riser when inserted into the slot is positioned below channel 326 such that the shackle 1204 when residing in channel 326 is located above the rail riser and prevents an upward travel of the riser, trapping the riser and attached weapon within the slot.

Figure 13:
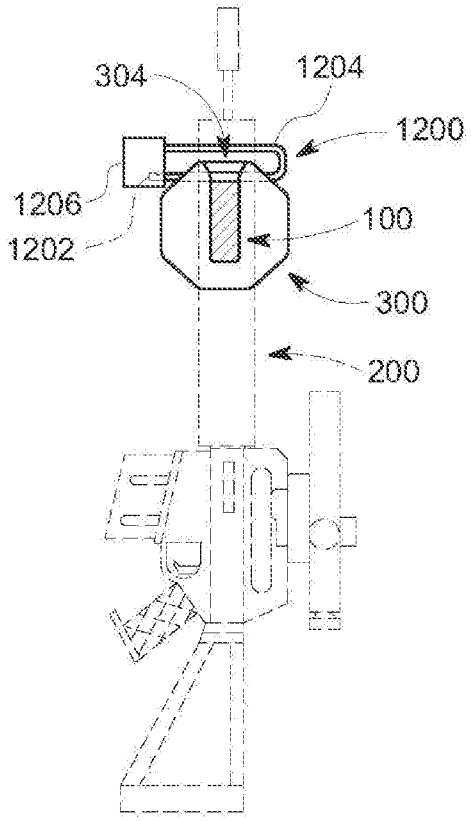
FIG. 13 is a front view of a firearms system with attached rail riser engaged within a wall mounted gun lock for a rail riser and secured with a lock, according to the illustrative embodiment.

FIG. 13 shows the rifle 200 (shown in broken lines) engaged with the gun lock 300. The rail riser attached to the rifle is residing within the gun lock 300, and the padlock is securing the rail riser and rifle to the gun lock.

Figure 14:
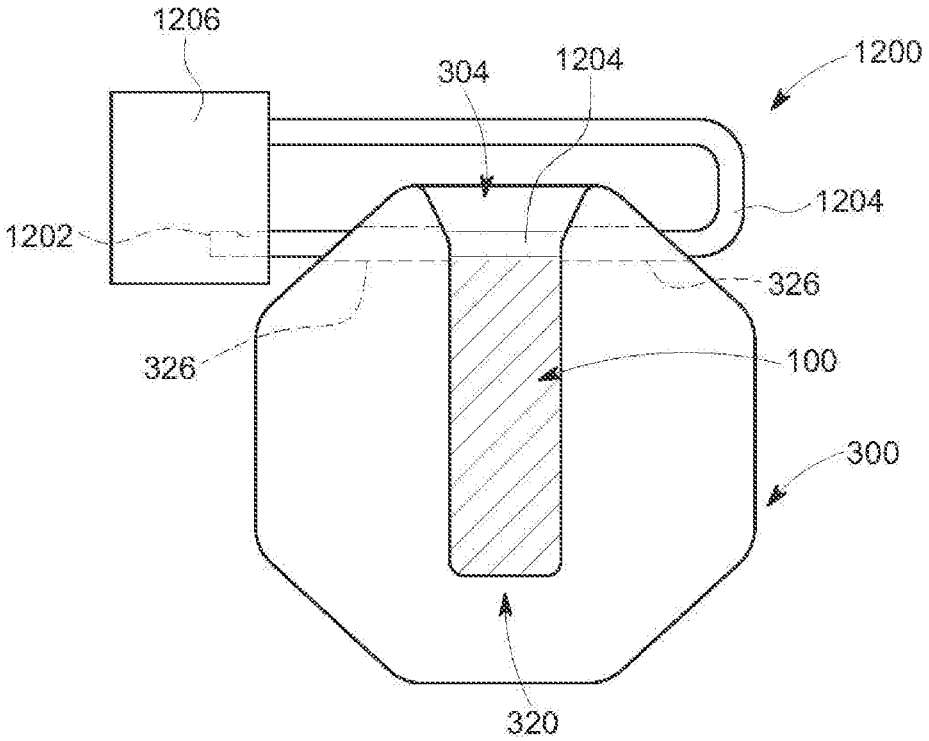
FIG. 14 is a close up view of a gun lock for a rail riser, according to the illustrative embodiment.

FIG. 14 is a close up view of the gun lock 300 of FIG. 13 with the padlock 1200 in a closed configuration. Movement of the rail riser 100 within the slot 304 is bounded on top by the shackle 1204 and at the bottom by the stop 320. Removal of the rifle from the gun lock follows the steps of removing a padlock from the gun lock if a padlock is present, and raising the rifle until the rail riser has travelled beyond the slot 304.

Figure 15:
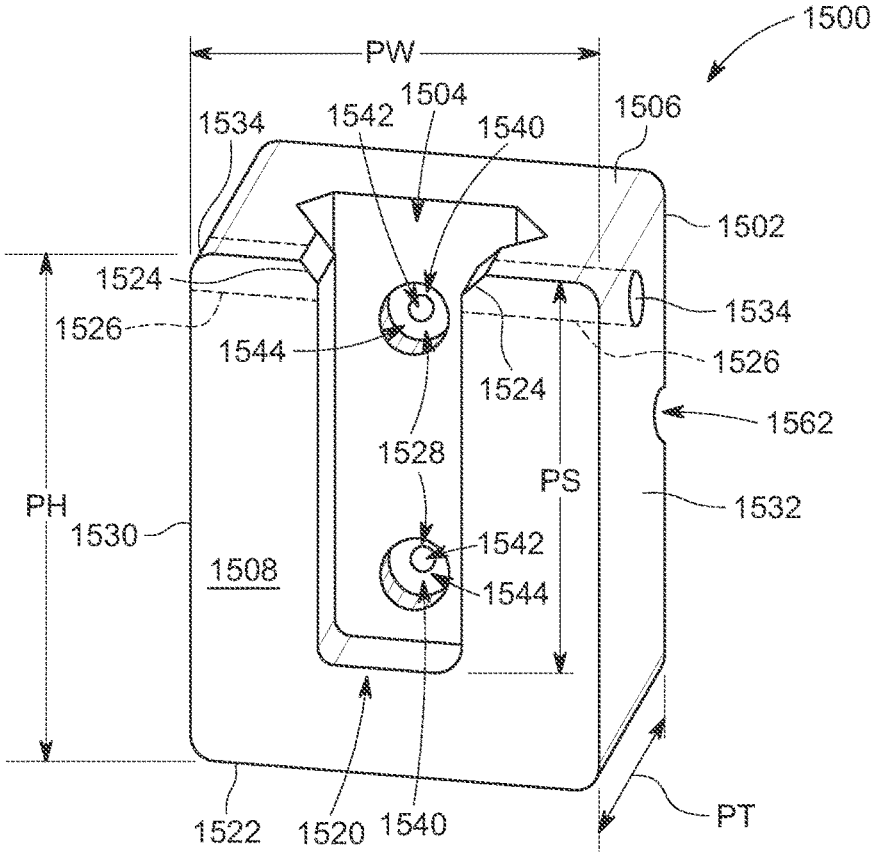
FIG. 15 is a perspective view of a gun lock for a rail riser, according to a third illustrative embodiment.

FIG. 15 is a perspective view of a gun lock 1500 for a rail riser, according to a third embodiment. The illustrative gun lock can be rectilinear in shape. This gun lock 1500 can function as the above described gun lock device 300. A gun lock 1500 can have a body 1502 that includes a slot 1504 sized to receive the rail riser 200, so that the elevated second rail segment of the rail riser can be slid into the slot 1504. Slot 1504 can extend from a top surface 1506 of the body 1502 along a front surface 1508 to a stop 1520 located above a bottom surface 1522. The body 1502 can also have a channel 1526 extending through an upper region of the body 1502 from one side to another so that the channel 1526 passes through an upper region of the slot 1504. The channel 1526 can be situated so as to be located above a top surface of a riser when the riser is placed into the slot. A padlock shackle, cotter pin, clevis pin, or the like can be inserted into the channel 1526 to prevent removal of a rail riser that has been placed within the slot. Because the bolt holes 120 and bolts 121 are located on the elevated second rail of the rail riser, when the rail riser is held within the slot 1504 the bolts are not exposed and cannot be removed from the rail riser, and so the rail riser cannot be removed from the weapon. The rail riser cannot be removed from the weapon until the rail riser is removed from the slot and the bolts are exposed.

As set forth above, when a shackle of a padlock is inserted into the channel 1526, the gun lock can hold an engaged weapon with rail riser and prevent removal of the weapon until the padlock is unlocked and removed. The gun lock body 1502 as shown can be a rectilinear shape in profile and is provided with a slot 1504 that opens to a top surface 1506. In an embodiment, the overall height PH of the gun lock 300 can be approximately 3.5 inches (±0.5 inches) and the overall width PW can be approximately 2 inches (±0.5 inches). The overall thickness PT can be approximately 0.875 inch (+0.25 inches). It is expressly contemplated that the thickness of the gun lock body can be greater as desired, for instance, to accommodate a rifle with large diameter optics or a weapon of unusual shape and dimensions. A front surface 1508 can be relatively flat in profile to avoid any obstruction to an engaged firearm in the gun lock. The slot 1504 can extend from the top surface 1506 along the body 1502 to a stop 1520 that is located above the bottom surface 1522. In an embodiment, the length of the slot PS can be approximately 2.75 inches (±0.5 inches). Slot 1504 can be provided with a pair of counterpoised slot shoulders 1524, a through channel 1526 and at least one mounting socket 1528. Counterpoised slot shoulders 1524 can slide within the grooves 112 of the rail riser 100 to help secure the rail riser 100 within the slot 1504. Slot shoulders 1524 can engage with the shoulders 100 and grooves 112 of the rail riser to prevent the riser from being pulled out from the front face 1502 of the gun lock 1500. In an embodiment, the gun lock 1500 can be provided with two mounting sockets 1528. It is contemplated that more than two mounting sockets can be provided. The top channel 1526 can extend from a left side 1530 to a right side upper facet 1532 and can be accessible by holes 1534.

A body 1502 can also have a locking cable passage 1562 that can be sized and shaped to accommodate a locking cable. By way of non-limiting examples, a locking cable passage 1562 can be a tunnel or can be an open furrow in the back face of the body 1502 that can extend from a left side to a right side of the body 1502. In an embodiment, passage 1562 can be in the shape of a semi-cylinder, having a semi-circular profile. In an embodiment, one mounting socket 1528 can be above the passage, and one mounting socket 1528 can be below the cable passage, so that a locking cable can be held between bolts within the mounting sockets.

Mounting holes 1528 can be stepped such that an outer hole 1540 is drilled into the body 1502 with a given diameter and an inner hole 1542, of a narrower diameter than that of the outer hole is centered and drilled within the outer hole, creating a shoulder 1544 such that a screw or bolt that is inserted into the inner hole will rest within the outer hole, and the head of that bolt will confront the shoulder 1544 and securely hold the gun lock 1500 to the wall (or other underlying attachment surface). Because the mounting holes 1528 are within the slot 1504, the body mounting bolts and bolt holes 1528 are covered by the rail riser when the rail riser is within the slot 1504, and the body mounting bolts cannot be removed from the body 1502 until the rail riser is removed from the slot 1504. Channel 1526 extends across the top of slot 1504 and is set within the slot so as not to obstruct the insertion, retention and removal of a rail riser in the slot. When a padlock shackle, cotter pin, clevis pin or the like is inserted into the channel 1526 and above a rail riser residing within the slot 1504, the padlock shackle prevents removal of the rail riser from the slot, which then also prevents removal of the riser bolts from the riser and prevents removal of the riser from the weapon, and prevents removal of the body mounting bolts from the body and prevents removal of the lock body from the wall or other mounting surface. The gun lock 1500 can be free of moving parts, and can be formed of a cast metal, for example, a zinc alloy, an aluminum alloy or another lightweight metal alloy, or a synthetic polymer, a ceramic, a fiber (glass, nylon, carbon, etc.), or a combination thereof. The overall weight of the gun lock will depend on the material used in it construction.

Figure 16:
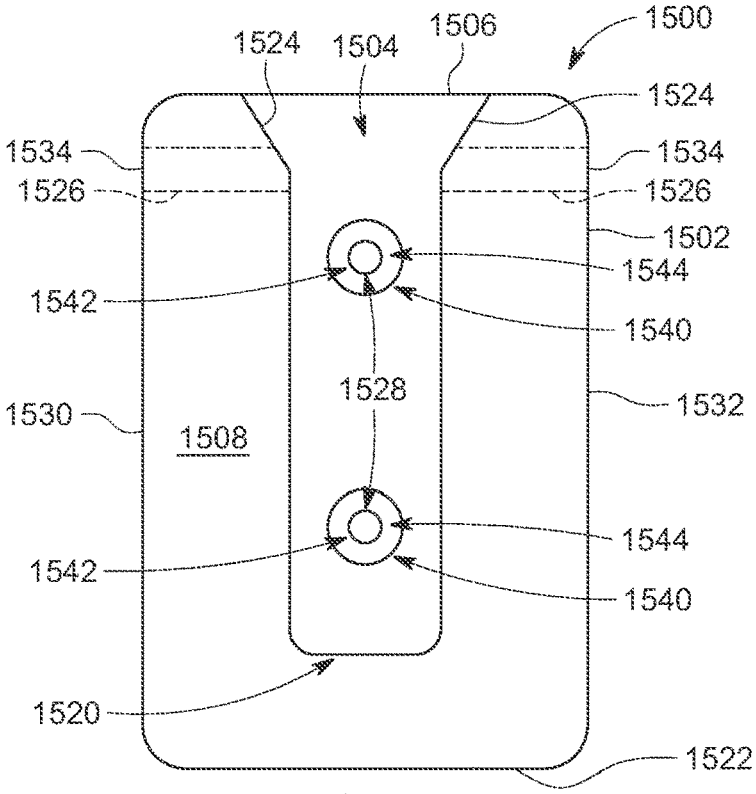
FIG. 16 is a front view of a gun lock for a rail riser, according to the third illustrative embodiment.

FIG. 16 is a front view of gun lock 1500. As shown herein, the gun lock 1500 can be rectilinear in profile and can be provided with a top surface 1506 and a bottom surface 1522, a left side 1530, a right side 1532.

Figure 17:
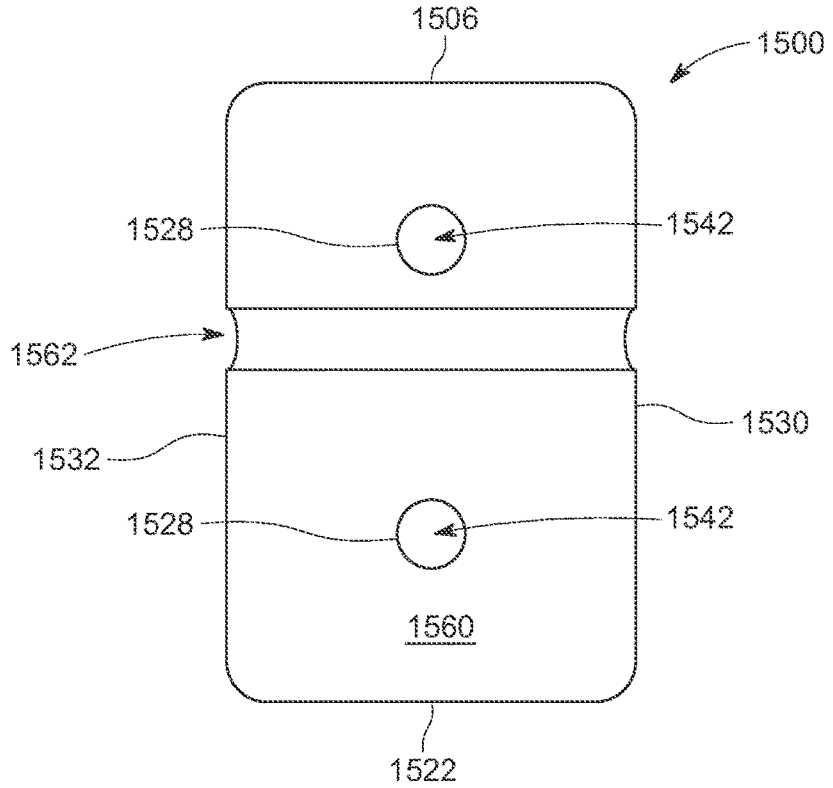
FIG. 17 is a rear view of a gun lock for a rail riser, according to the third illustrative embodiment.

FIG. 17 is a rear view of a gun lock 1500. Gun lock 1500 can have a flat rear surface 1560 with two perforations that are holes 1542 for mounting screws. Gun lock 1500 can have a passage 1562 from the left side to the right side. Passage 1562 can be semi-cylindrical or other shapes. Passage 1562 can pass between the holes 1542. A user can secure a locking cable within the passage 1562, so that the locking cable can be used to secure a firearm. The locking cable can be secured between the body 1502 and the wall that the body 1502 is mounted to, and between the bolts that pass through holes 1542 and into the wall. While rear surface 1560 is shown as being smooth, it is contemplated that the surface could be provided with a texture to enhance the gripping qualities of an adhesive if desired.

Figure 18:
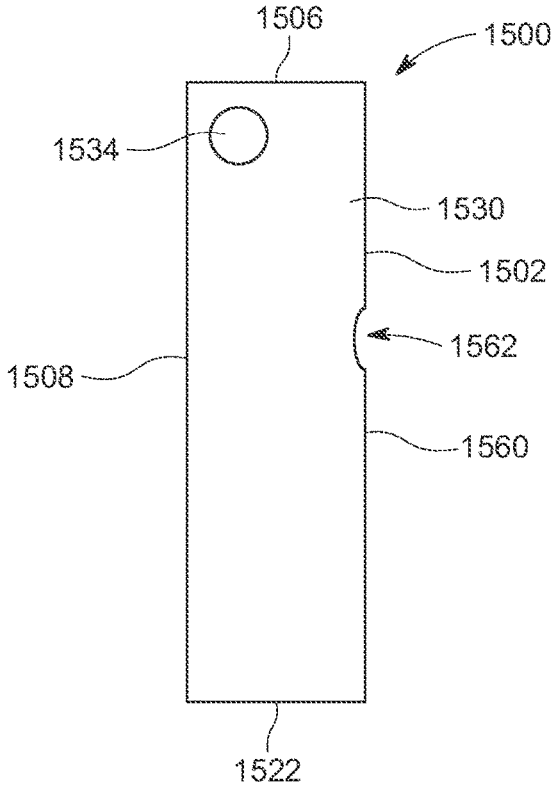
FIG. 18 is a first side view of a gun lock for a rail riser, according to the third illustrative embodiment.

FIG. 18 is a first side view of gun lock 1500 showing the details and surfaces of the right side of the gun lock. Hole 1534 can be centered, or can be off-center and closer to the front surface 1508 than the rear surface 1560. Passage 1562 can be centered or off center, and can be a closed tunnel, or can be a semi-cylindrical furrow or other shapes.

Figure 19:
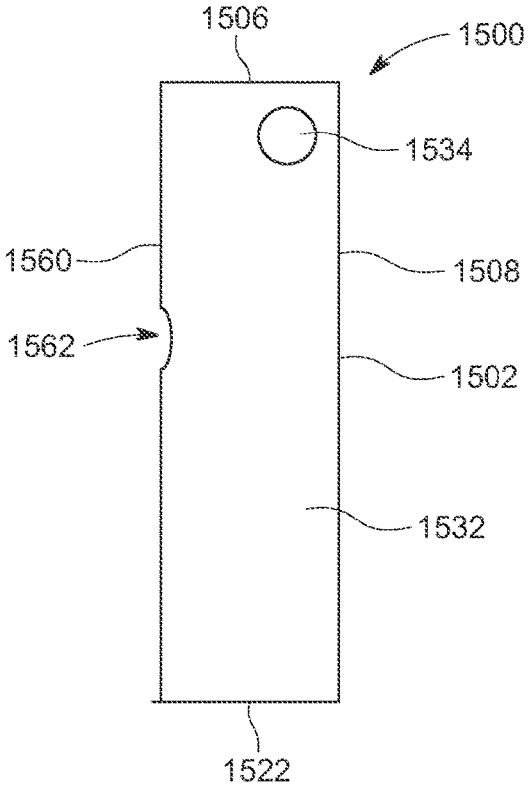
FIG. 19 is a second side view of a gun lock for a rail riser, according to the third illustrative embodiment.

FIG. 19 is a second side view of gun lock 1500 showing the details and surfaces of the left side of the gun lock. As noted above, hole 1534 can be centered or can be off-center, and closer to the front surface 1508 than the rear surface 1560. Passage 1562 can be centered or off center, and can be a closed tunnel, or can be a semi-cylindrical furrow or other shapes.

Figure 20:
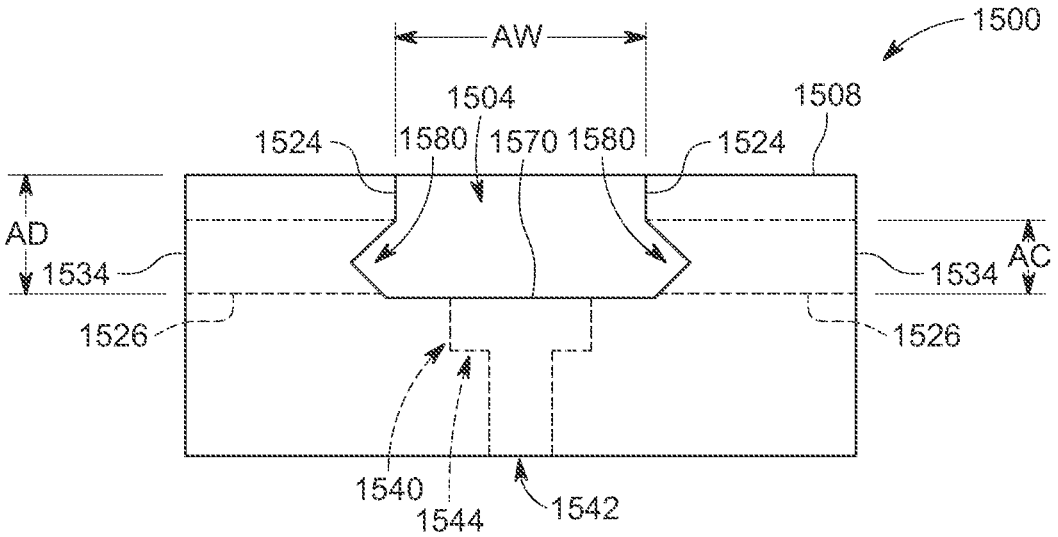
FIG. 20 is a top view of a gun lock for a rail riser, according to the third illustrative embodiment.

FIG. 20 is a top view of gun lock 1500. In an embodiment, rear wall 1570 of slot 1504 may not be located as close to the rear surface 1560 as the channel 1526, so that a portion of the channel 1526 may be seen along the rear wall 1570. Because the channel 1526 can be partially inscribed within the rear wall 1570, a padlock shackle can be at least partially protected by the rear wall 1570, thereby preventing a prying tool from being slid behind the shackle, preventing a cutting tool from accessing and cutting the entire shackle within the lock body, etc. Side grooves 1580 in slot 1504 function with regard to the elevated second rail of an inserted rail riser in the same manner that the side grooves 122 (described above) of the rail riser function with respect to the rail of the weapon. The side grooves 1580 accommodate the insertion of top shoulders 110 (described above) and prevent lateral rotation and movement of the rail riser when engaged in the slot 1504. When top shoulders 110 are slid within the side grooves 1580, the engagement of the top shoulders 110 within the grooves 1580 prevents the rail riser from being pulled out through the front face 1508 of the lock body 1500. The slot width AW can be approximately 0.690 inch (±0.25 inches). The slot depth AD can be approximately 0.230 inch (±0.25 inches). Side grooves 380 can have a depth AC of 0.230 can be approximately 0.875 inch (±0.25 inches).

Figure 21:
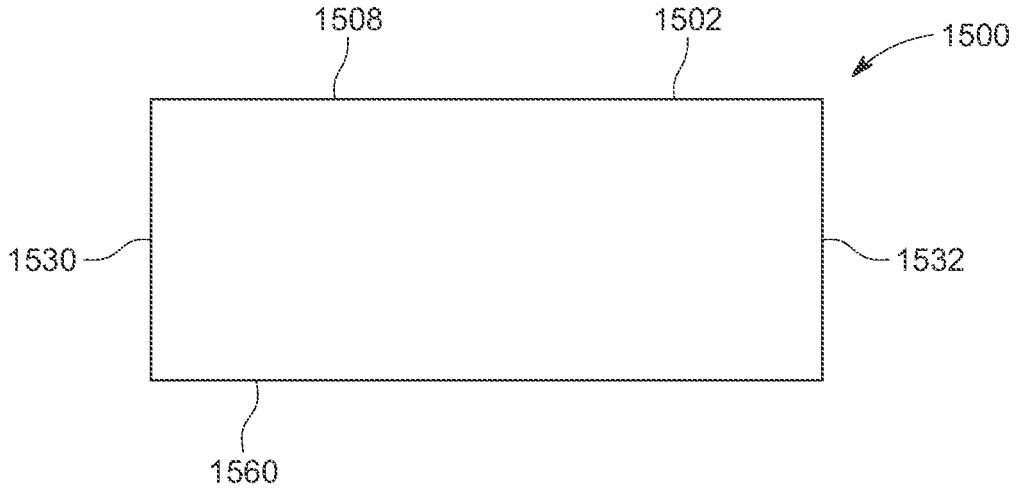
FIG. 21 is a bottom view of a gun lock for a rail riser, according to the third illustrative embodiment.

FIG. 21 is a bottom view of a gun lock 1500. The slot 1504 does not extend to the bottom surface 1532 and an inserted riser rests on stop 1520 (shown above in FIG. 8).

Figure 22:
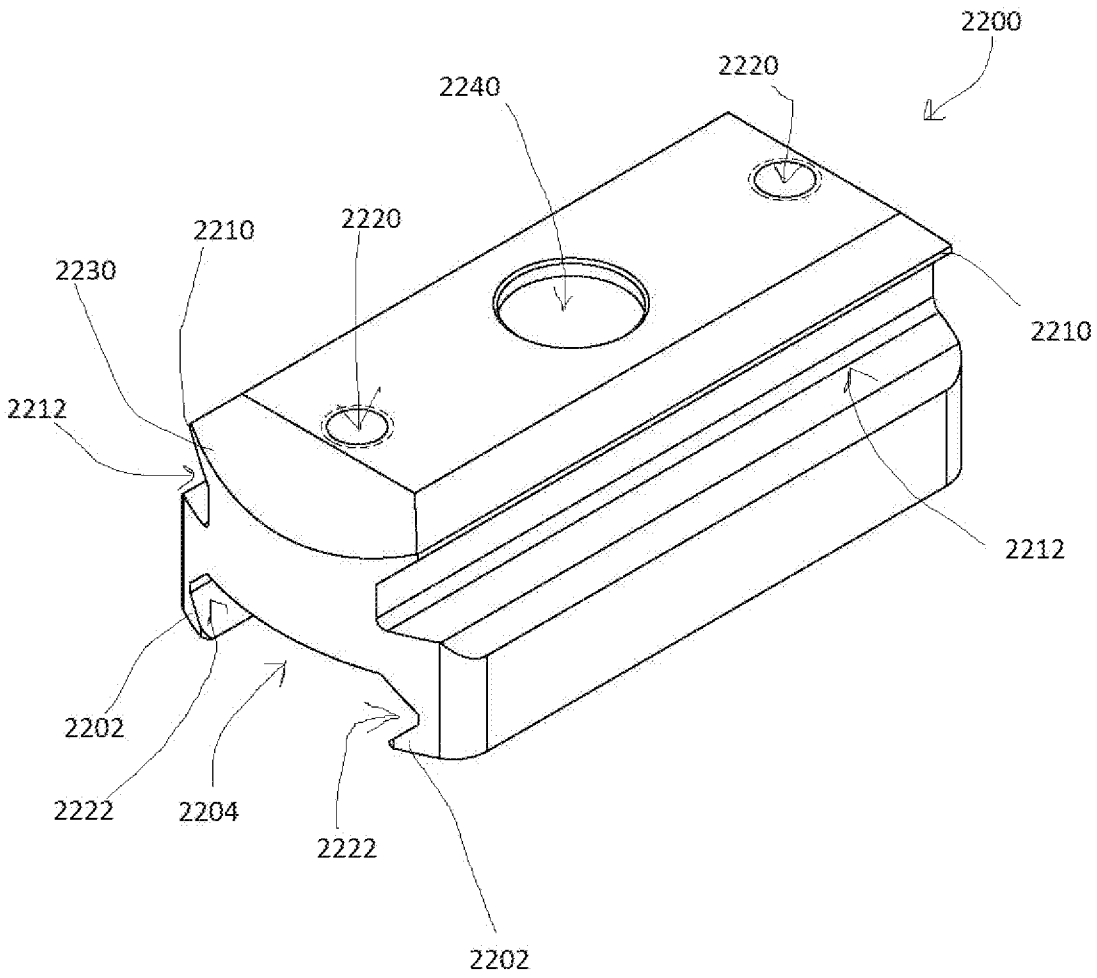
FIG. 22 is a perspective view of an exemplary rail riser, according to a second illustrative embodiment.

FIG. 22 is a perspective view of an exemplary rail riser, according to a second embodiment. The rail riser 2200 is an accessory that can be attached to one of a rail of a firearms rail system. The rail riser 2200 can slide onto an existing rail on a weapon, and can include an elevated second rail segment 2230. The rail riser 2200 is provided with rail holders 2202 and a main channel groove 2204 for engaging the rail system on a weapon. The top shoulders 2210 and adjacent grooves 2212 can be inserted into a locking mechanism (not shown). The rail riser 2200 can be removably attached to a firearm and can be used in turn to attach the firearm to a locking mechanism. The rail riser is proportioned and dimensioned to readily attach to a firearm rail system. The rail riser 2200 can be attached to a firearm rail system by one or more bolts that can be inserted through the rail riser via through holes 2220 that can be threaded. The one or more bolts can be inserted through holes 2220 into a space between segments of the rail. Side grooves 2222 that are within the main channel groove 2204 engage the weapon's rail on either side and prevent lateral rotation or movement of the rail riser. This function of the side grooves 2222 in combination with one or more bolts inserted down the through holes 2220 into the gaps in the rail secures the rail riser to the rail. The rail riser can have a central well 2240 that can accommodate a locking tumbler.

Figure 23:
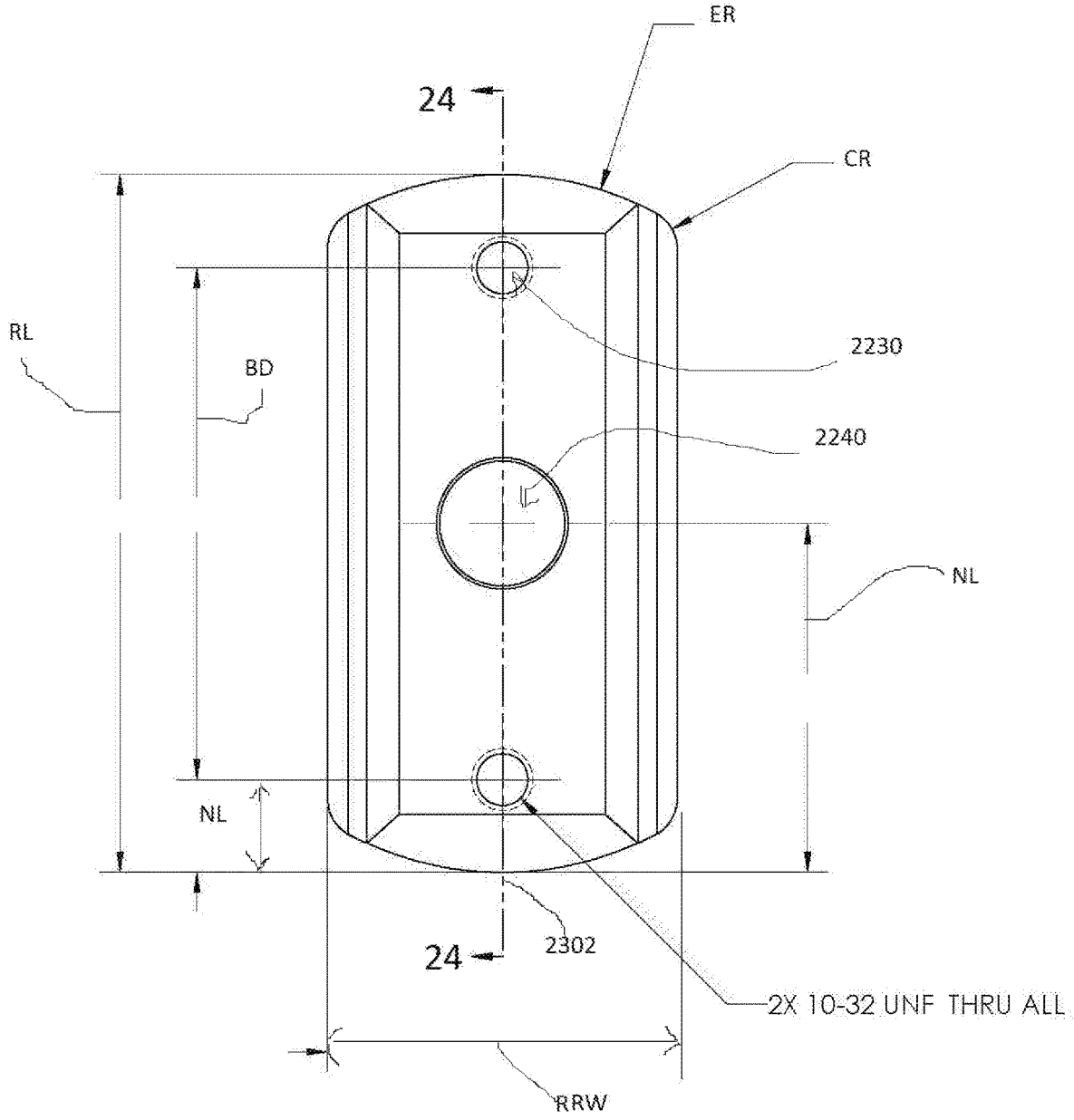
FIG. 23 is a top view of the rail riser, according to the second illustrative embodiment.

FIG. 23 is a top view of the rail riser, according to the second illustrative embodiment. In various embodiments, a rail riser can have a rail riser length RL from one end of the rail riser to the opposite end that can be approximately 2.2 inches. The rail riser can have a bolt span distance BD between the centers of the bolt holes 2220 that can be approximately 1.6 inches. The rail riser can have a nose length NL between the center of a bolt hole 2220 and the frontmost leading edge, or nose, 2302 of the rail riser that can be approximately 0.29 inch. The rail riser can have a nose distance ND between the nose 2302 and the center of the central well 2240 that can be approximately 1.1 inches. The top and bottom edges of the rail riser can have curved edge radii ER of approximately 1 inch. The corners of the rail riser can have curved corner radii CR or approximately 0.13 inch. The rail riser can have a rail riser width RRW from one side to the other that can be approximately 1.1 inches. Other ranges of dimensions are expressly contemplated.

Figure 24:
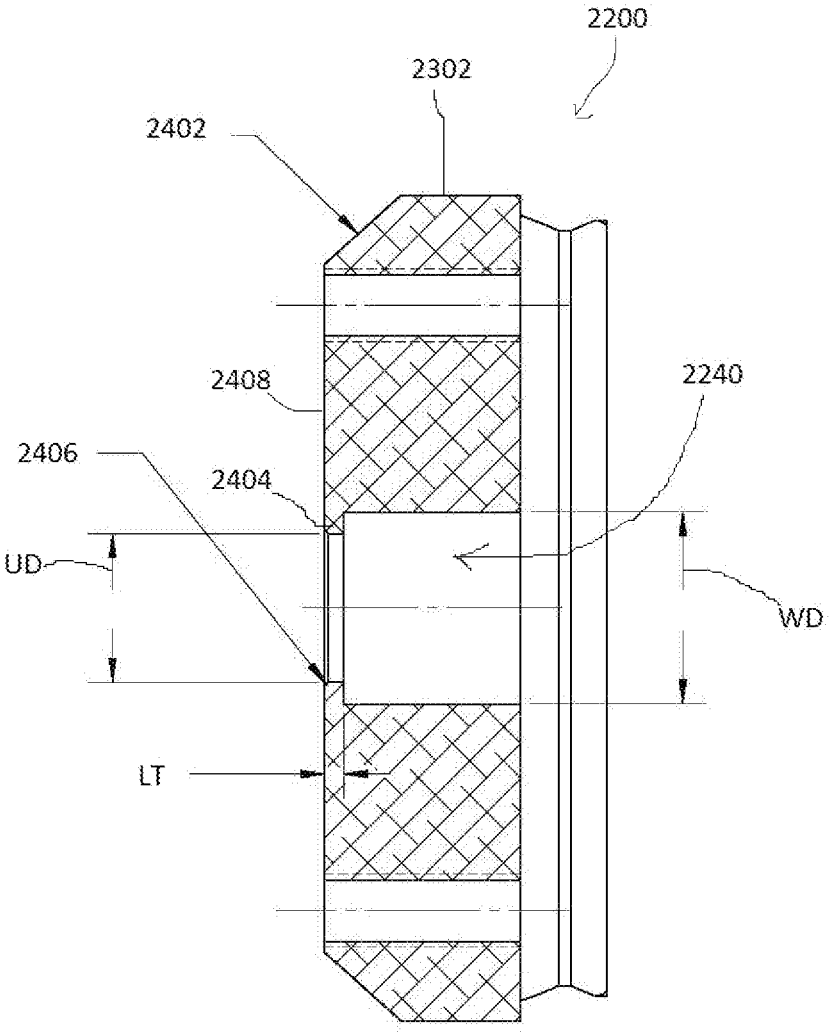
FIG. 24 is a cross section view of the rail riser according to the second illustrative embodiment, taken along cross-section line 24-24 of FIG. 23.

FIG. 24 is a cross section view of the rail riser according to the second illustrative embodiment, taken along cross-section line 24-24 of FIG. 23. The rail riser 2200 can have a nose taper 2402 between the nose 2302 and the top surface 2408 of the rail riser, and the nose taper section 2402 can be at a 45° degree angle to the top surface of the rail riser. The central well 2240 can have a well diameter WD of 0.5 inches. The top of the lip can have a retaining lip 2404 that can reduce the diameter of the opening at the top of the central well 2240. The retaining lip 2404 can result in an upper diameter UD at the top of the central well 2240 that can be approximately 0.39 inches. The retaining lip 2404 can have a lip thickness LT of approximately 0.05 inches. The retaining lip 2404 can have a lip bevel section 2406 that can be approximately 0.01 inches long and can be at a 45° degree angle to the top surface of the rail riser. The retaining lip can be used to hold a clip for a strap, a handle, or another device used to hold the weapon, so that the weapon can be held by the rail riser 2200.

Figure 25:
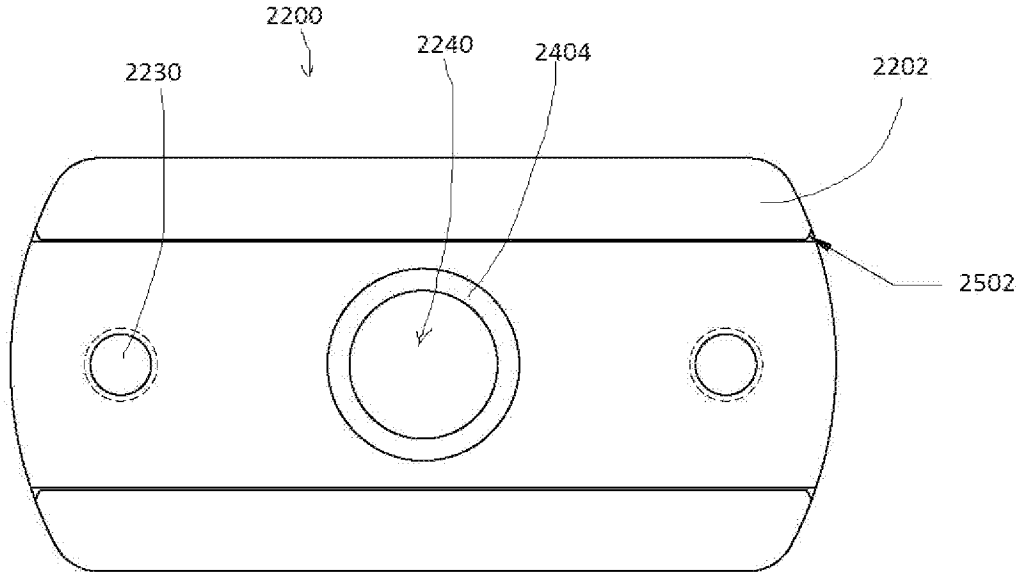
FIG. 25 is a bottom view of the rail riser, according to the second embodiment.
Figure 26:
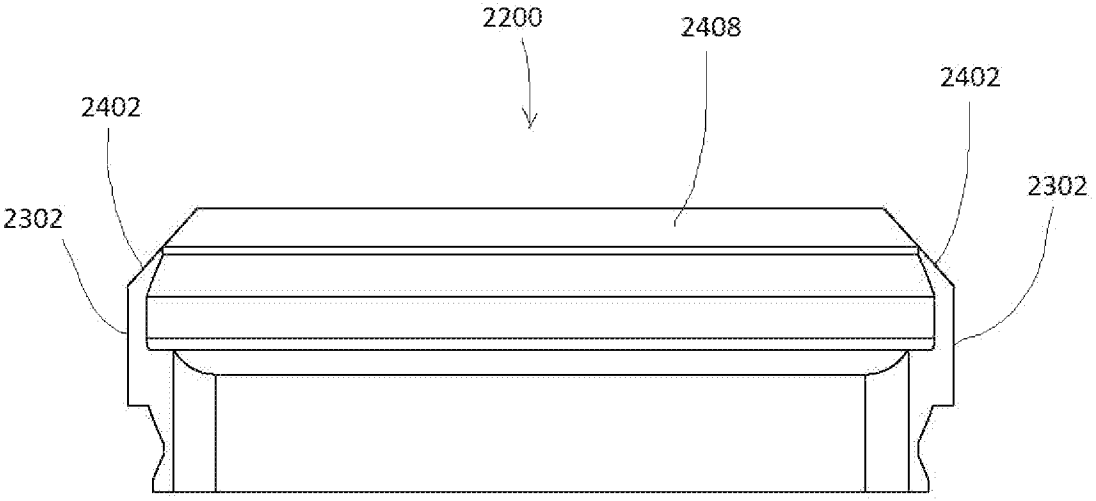
FIG. 26 is a side view of the rail riser, according to the second embodiment.

FIG. 25 is a bottom view of the rail riser, according to the second embodiment. Rail holders 2202 can have a rounded front point 2502 that can make installation of the rail riser onto the rail of a weapon easier. The rounded front point 2502 can have a radius of approximately 0.05 inches. FIG. 26 is a side view of the rail riser, according to the second embodiment, showing the top surface 2408, nose taper 2402, and nose 2302.

Figure 27A:
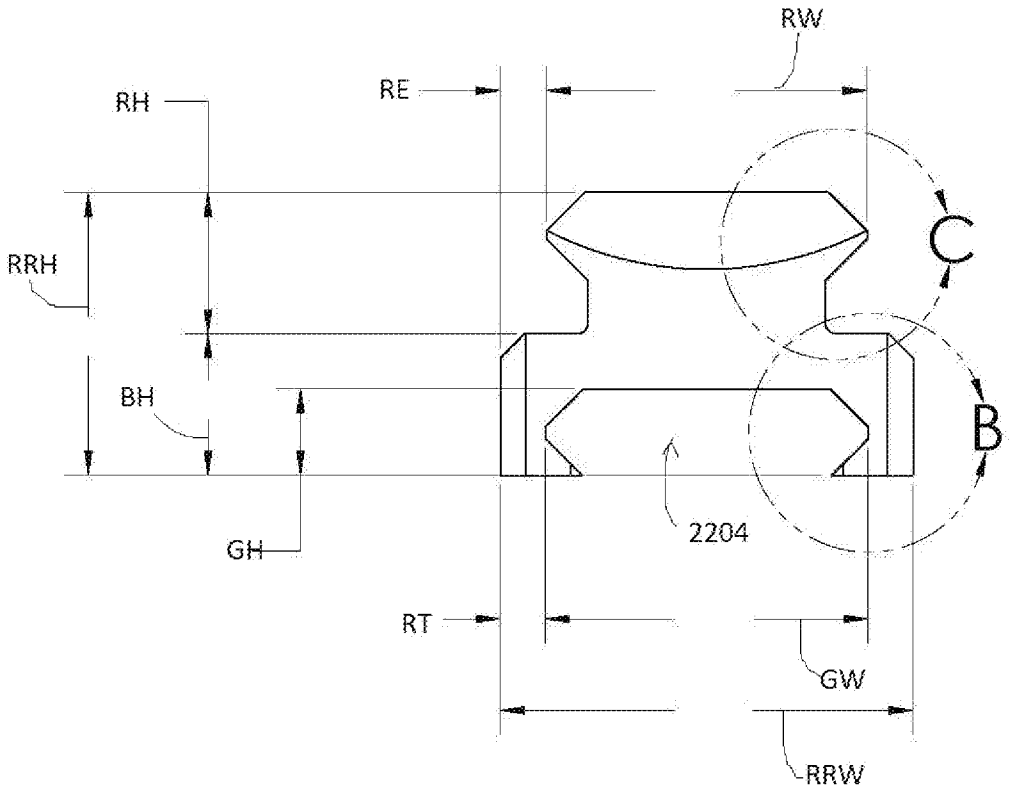
FIG. 27A is an end view of the rail riser, according to the second embodiment.

FIG. 27A is an end view of the rail riser, according to the second embodiment. The rail riser can have a rail width RW from one side of the rail to the other that can be approximately 0.835 inches. The main channel groove 2204 can have a groove width GW of approximately 0.84 inches, and a groove height GH of approximately 0.225 inches, so that it can accommodate a standard weapon rail. The rail riser can have a rail riser height RRH from the top surface to the bottom of the rail riser of approximately 0.74 inch. The rail riser can have a riser height RH of approximately 0.37 inch, and a base height BH of approximately 0.37 inch. The rail riser can have a rail holder thickness RT of approximately 0.118 inch, and a rail holder extension RE of approximately 0.12 inch.

Figure 27B:
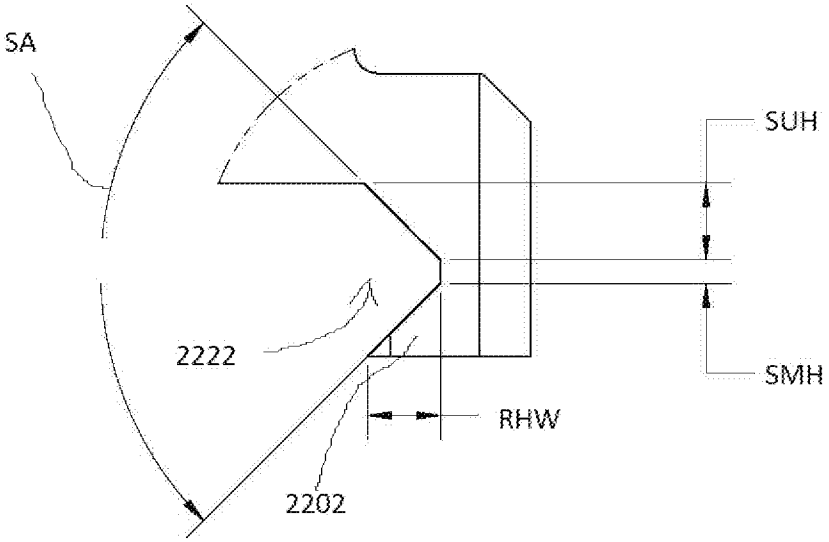
FIG. 27B is an enlarged view of detail area B of the rail riser of FIG. 27A, according to an illustrative embodiment.
Figure 27C:
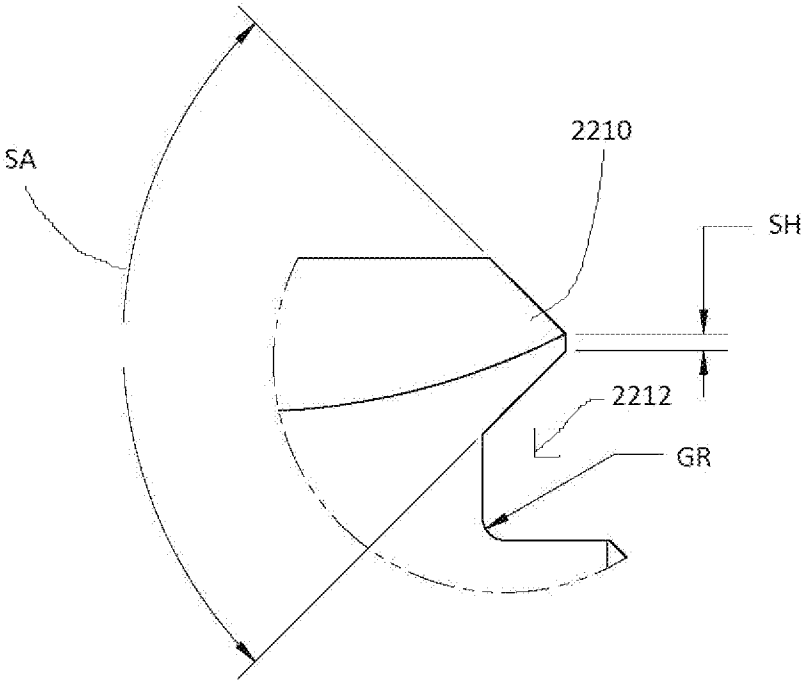
FIG. 27C is an enlarged view of detail area C of the rail riser of FIG. 27A, according to an illustrative embodiment.

FIG. 27B is an enlarged view of detail area B of the rail riser of FIG. 27A, according to an illustrative embodiment. A side groove 2222 can have a side groove minimum height SMH of approximately 0.031 inch, a side groove upper height SUH of approximately 0.1 inch, and a side groove angle GA of approximately 90°. A rail holder 2202 can have a rail holder width RHW of approximately 0.95 inches. FIG. 27C is an enlarged view of detail area C of the rail riser of FIG. 27A, according to an illustrative embodiment. Top shoulder 2210 can have a minimum shoulder height SH of approximately 0.021 inch, and a top shoulder angle SA of approximately 90° The adjacent groove 2212 can have a groove radius GR of approximately 0.03 inch.

Figure 28:
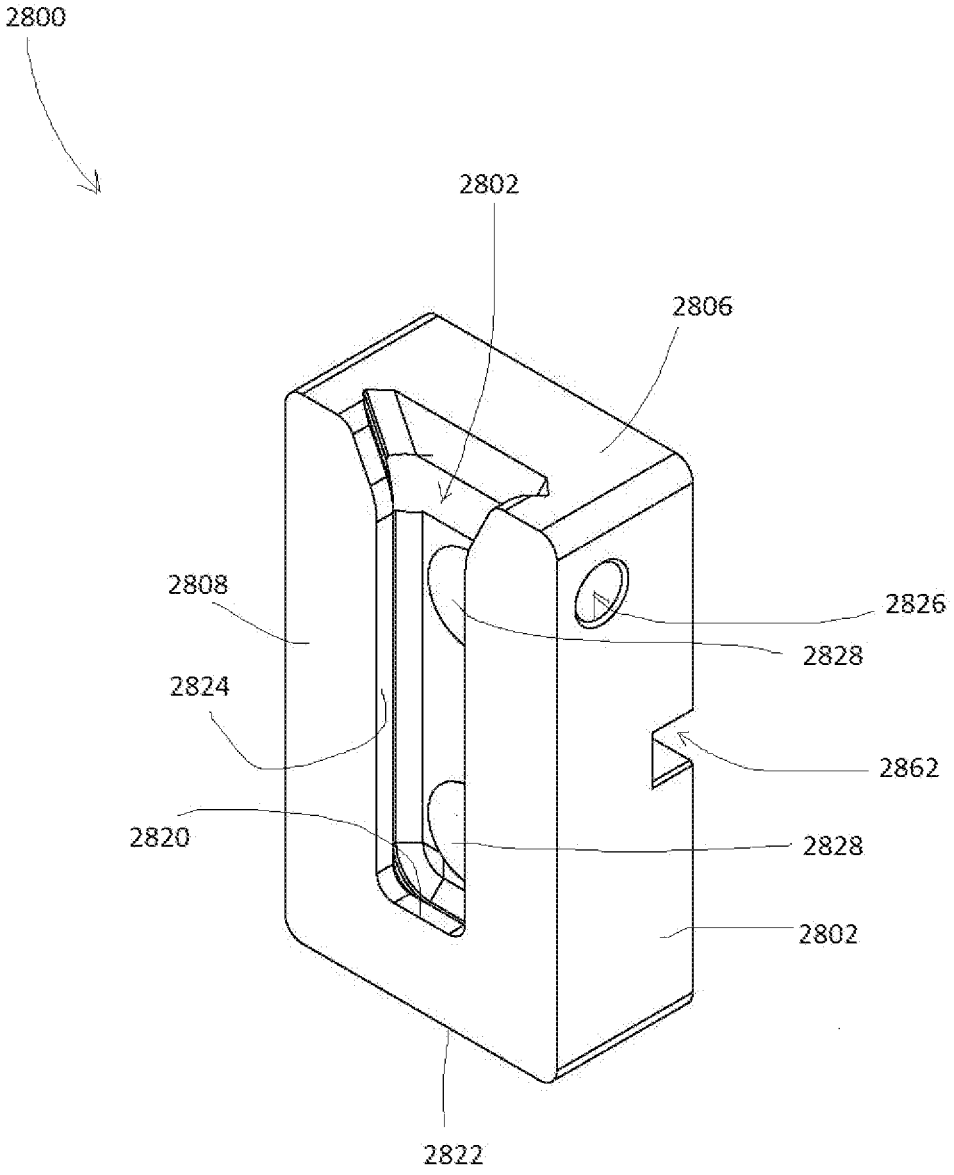
FIG. 28 is a perspective view of a gun lock for a rail riser, according to a fourth embodiment.

FIG. 28 is a perspective view of a gun lock for a rail riser, according to a fourth embodiment. The gun lock system can include a rail riser and a gun lock 2800. A gun lock 2800 can have a body 2802 that includes a slot 2804 sized to receive the rail riser, so that the elevated second rail segment of the rail riser can be slid into the slot 2804. Slot 304 can extend from a top surface 2806 of the body 2802 along a front surface 2808 to a stop 2820 located above a bottom surface 2822. The body 2802 can also have a channel 2826 extending through an upper region of the body 2802 from one side to another so that the channel 2826 passes through an upper region of the slot 2804. The channel 2826 can be situated so as to be located above a top surface of a riser when the riser is placed into the slot. The channel 2826 can accommodate a padlock, cotter pin, clevis pin or the like. The shape profile of the body 2802 can be an octagon, a rectangle, or other shapes. A padlock shackle can be inserted into the channel 2826 to prevent removal of a rail riser that has been placed within the slot. Because the bolt holes 2220 and bolts 121 are located on the elevated second rail of the rail riser, when the rail riser is held within the slot 2804 the bolts are not exposed and cannot be removed from the rail riser, and so the rail riser cannot be removed from the weapon. The rail riser cannot be removed from the weapon until the rail riser is removed from the slot and the bolts are exposed.

When a shackle of a padlock is inserted into the channel 2826, the gun lock can hold an engaged weapon with rail riser and prevent removal of the weapon until the padlock is unlocked and removed. The gun lock system can include a rail riser that is attached to a rifle, a wall mounted gun lock 2800 and an optional padlock 1200. The gun lock body 2802 as shown can be, by way of non-limiting example, a substantially rectangular shape in profile and is provided with a slot 2804 that opens to one of the side surfaces, such as the top surface 2806 as shown. The slot 2804 is sized and dimensioned as to length, width and depth to receive and retain a rail riser (not shown). Slot 2804 is the receiving slot for the rail riser. The slot 2804 can extend from the top surface 2806 along the body 2802 to a stop 2820 that is located above the bottom surface 2822.

Slot 2804 can be provided with a pair of counterpoised slot shoulders 2824, a through channel 2826 and at least one mounting socket 2828. Counterpoised slot shoulders 2824 can slide within the grooves of the rail riser to help secure the rail riser within the slot 2804. Slot shoulders 2824 can engage with the shoulders and grooves of the rail riser to prevent the riser from being pulled out from the front face of the gun lock 2800. In an embodiment, the gun lock 2800 can be provided with two mounting sockets 2828. It is contemplated that more than two mounting sockets can be provided.

A body 2802 can also have a locking cable passage 2862 that can be sized and shaped to accommodate a locking cable. By way of non-limiting examples, a locking cable passage 2862 can be a tunnel or can be an open furrow in the back face of the body 2802 that can extend from a left side to a right side of the body 2802. In an embodiment, passage 2862 can be in the shape of a semi-cylinder, having a semi-circular profile. In an embodiment, one mounting socket 2828 can be above the passage, and one mounting socket 2828 can be below the cable passage, so that a locking cable can be held between bolts within the mounting sockets.

Because the mounting holes 2828 are within the slot 2804, the body mounting bolts and bolt holes 2828 are covered by the rail riser when the rail riser is within the slot 2804, and the body mounting bolts cannot be removed from the body 2802 until the rail riser is removed from the slot 2804, thereby exposing the body mounting bolts and bolt holes 2828. Channel 2826 extends across the top of slot 2804 and is set within the slot so as not to obstruct the insertion, retention and removal of a rail riser in the slot. When a padlock shackle is inserted into the channel 2826 and above a rail riser within the slot 2804, the padlock shackle prevents removal of the rail riser from the slot, which then also prevents removal of the riser bolts from the riser and prevents removal of the riser from the weapon, and prevents removal of the body mounting bolts from the body and prevents removal of the lock body from the wall or other mounting surface. Top surface 2806 can be a flat surface perpendicular to the orientation of slot 2804, can be angled downwards on both sides towards the slot to guide the rail riser into the slot 2804, or can have flat portions on either side of a downwardly angled "V" portion above the slot (as shown in FIG. 28), or other possible shapes.

Figure 29:
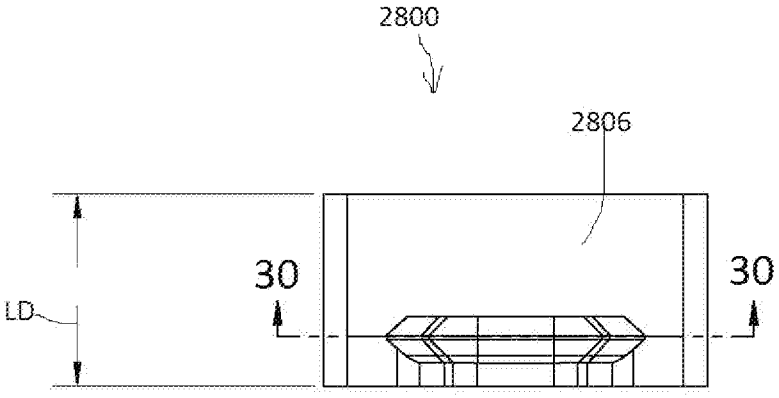
FIG. 29 is a top view of a gun lock for a rail riser, according to the fourth embodiment.
Figure 30:
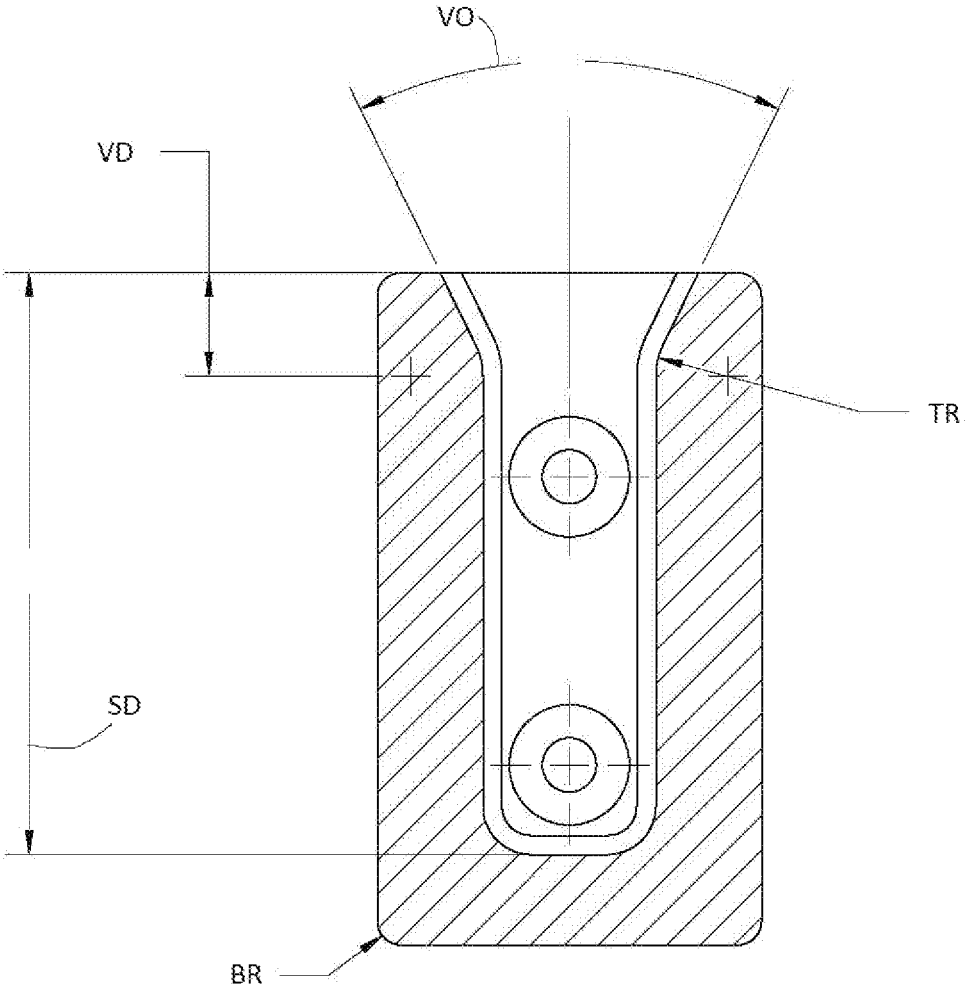
FIG. 30 is a cross section view of the gun lock for a rail riser according to the fourth illustrative embodiment, taken along cross section line 30-30 of FIG. 29.

FIG. 29 is a top view of a gun lock for a rail riser, according to the fourth embodiment. A gun lock 2800 can have a lock depth LD of approximately 1 inch, however, the lock depth can be highly variable. In various embodiments, a thicker lock depth can be used to accommodate, for example, optics attached to the weapon lights, or other attachments on the weapon. FIG. 30 is a cross section view of the gun lock for a rail riser according to the fourth illustrative embodiment, taken along cross section line 30-30 of FIG. 29. The slot 2804 can have an entry portion that can be an angled section, or "V" section, between the opening of the slot and a straight portion of the slot. In various embodiments, the angled section, or "V" section of the slot 2804 can have a "V" section depth VD between the opening and a straight portion of the slot of approximately 0.5 inch. The "V" section can have an opening VO of approximately 52° degrees. A transition between the "V" section and the straight section can have a curved transition with a radius TR that can be approximately 0.4 inches. The lock body can have an overall slot depth SD that can be approximately 3 inches. The corners of the lock body can be rounded, and can have body corner radii BR of approximately 0.1 inch.

Figure 31:
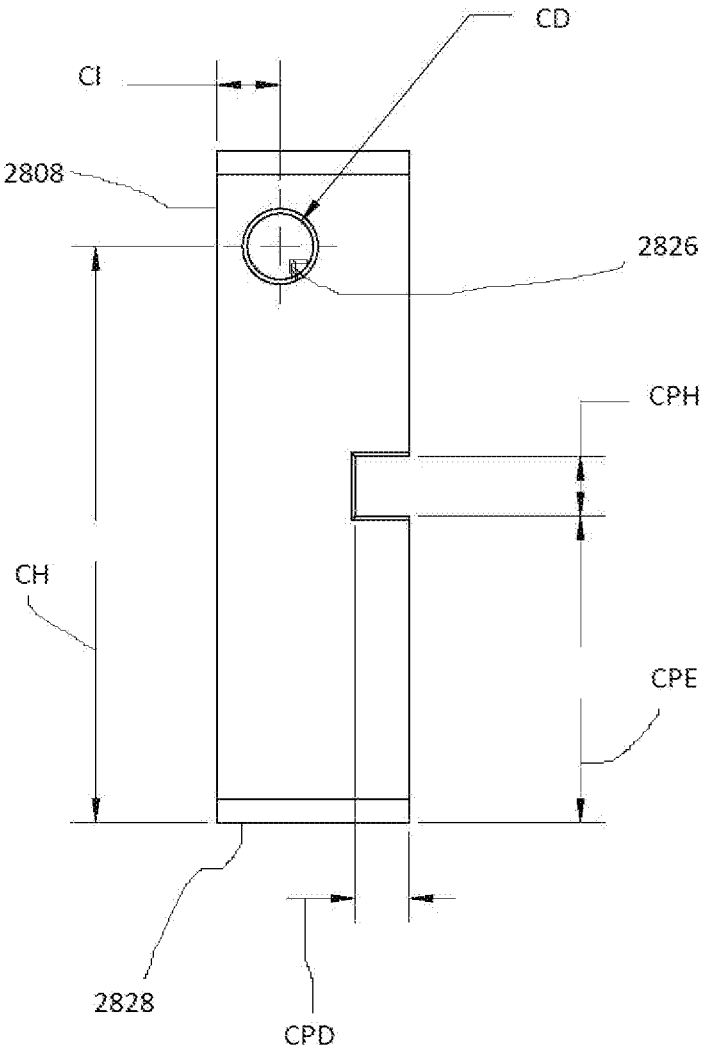
FIG. 31 is a side view of a gun lock for a rail riser, according to the fourth embodiment.

FIG. 31 is a side view of a gun lock for a rail riser, according to the fourth embodiment. The channel 2826 can have a channel diameter CD of approximately 0.34 inch, and can have a channel inset CI from the center axis of the channel to the front face 2808 of approximately 0.33 inch. The channel 2826 can have a channel height CH from the center axis of the channel to the bottom edge 2822. The locking cable passage 2862 can have a cable passage height CPH of approximately 0.3 inch, and a cable passage depth CPD of approximately 0.3 inch. The cable passage can have a cable passage elevation CPE of approximately 1.6 inch.

Figure 32:
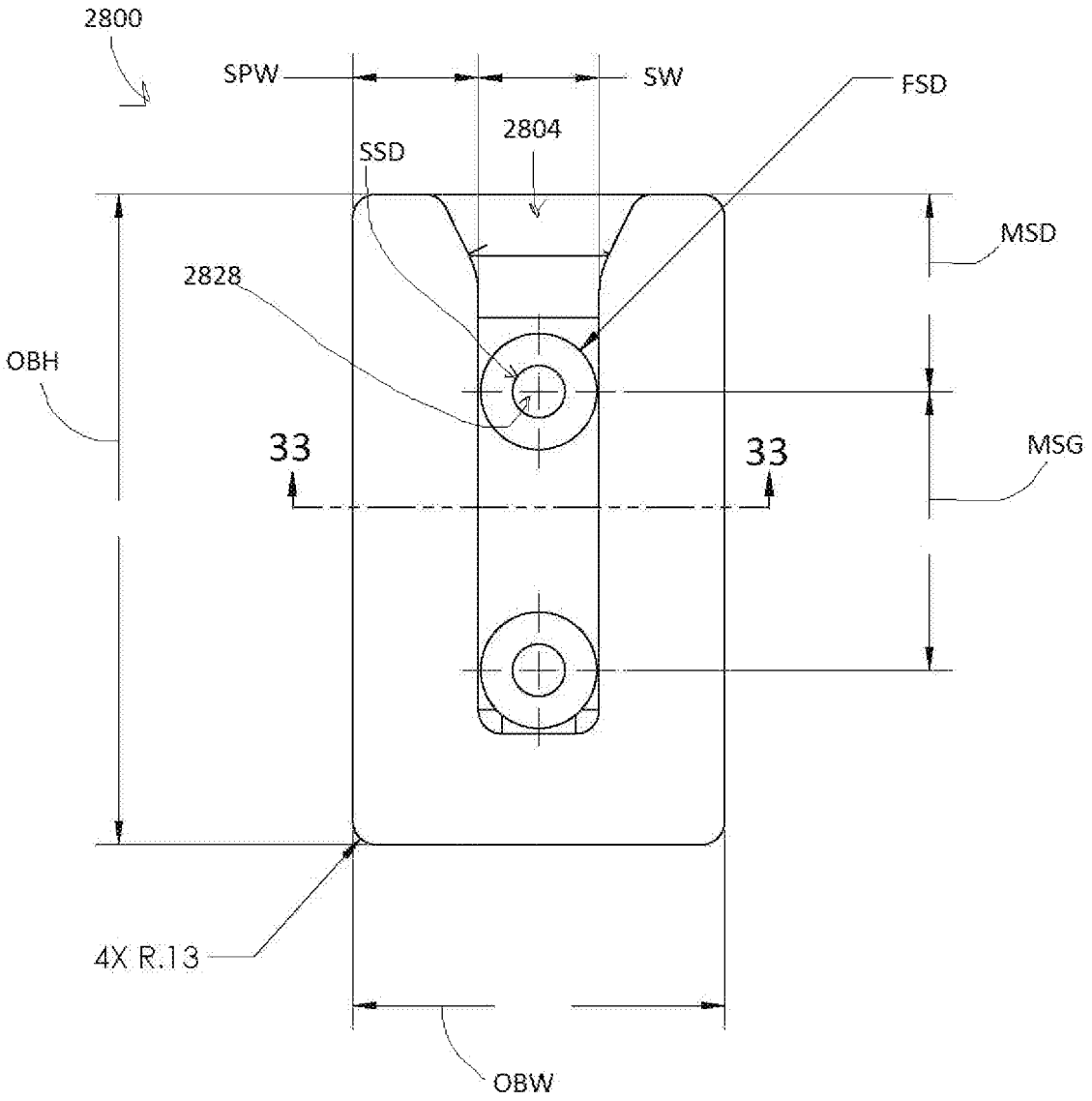
FIG. 32 is a front view of a gun lock for a rail riser, according to the fourth embodiment.

FIG. 32 is a front view of a gun lock for a rail riser, according to the fourth embodiment. The gun lock body can have an overall body height OBH from the top of the body to the bottom of the body of approximately 3.5 inches and an overall body width OBW from one side of the body to the other side of the body of approximately 2 inches. Mounting socket 2828 can have a first mounting socket diameter FSD of approximately 0.63 inches at the opening of the socket. The first mounting socket diameter can start inside the slot and can extend approximately 0.38 inch towards the back of the body 2802 so that the socket can accommodate the head of a bolt within the first mounting socket diameter. The mounting socket 2828 can have a second mounting socket diameter SSD of approximately 0.28 inches through to the back of the body, so that the mounting socket 2828 defines a hole that passes from the slot through the body to the back of the body, and the mounting socket has a first diameter and a second diameter. The mounting socket 2828 can have a mounting socket depth MSD from the top surface of the lock body to the center axis of one mounting socket that can be approximately 1.1 inches. Two mounting sockets can be separated by a mounting socket gap MSG measured between the first socket center axis and the second socket center axis that can be approximately 1.5 inches. A mounting slot 2804 can have a slot width SW, measured from one edge of the slot to the other edge of the slot and below the "V" section at the front of the lock body, of approximately 0.65 inch. The lock body can have a side panel width SPW, measured from the edge of the slot to the side edge of the body at the front of the body, or approximately 0.68 inches.

Figure 33A:
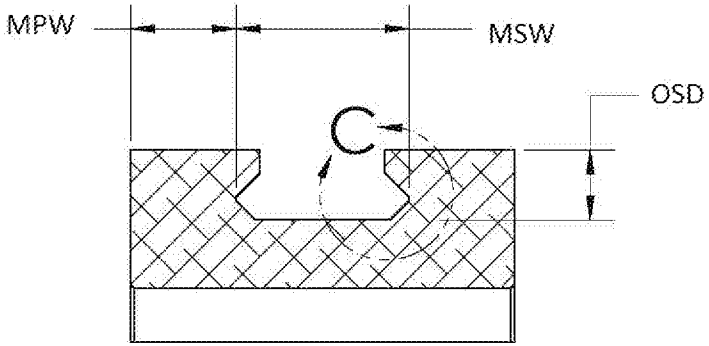
FIG. 33A is a cross section view of the gun lock for a rail riser according to the fourth illustrative embodiment, taken along cross section line 33-33 of FIG. 32.

FIG. 33A is a cross section view of the gun lock for a rail riser according to the fourth illustrative embodiment, taken along cross section line 33-33 of FIG. 32. A slot 2804 can have a maximum slot width MSW measured from one side of the slot to the other side of the slot at the widest point of the slot of approximately 0.9 inch. The lock body can have a minimum side panel width MPW, measured from the widest point of the slot to the side edge of the lock body of approximately 0.55 inch. The slot can have an overall slot depth OSD measured from the front face of the body to the back of the slot of approximately 0.37 inch.

Figure 33B:
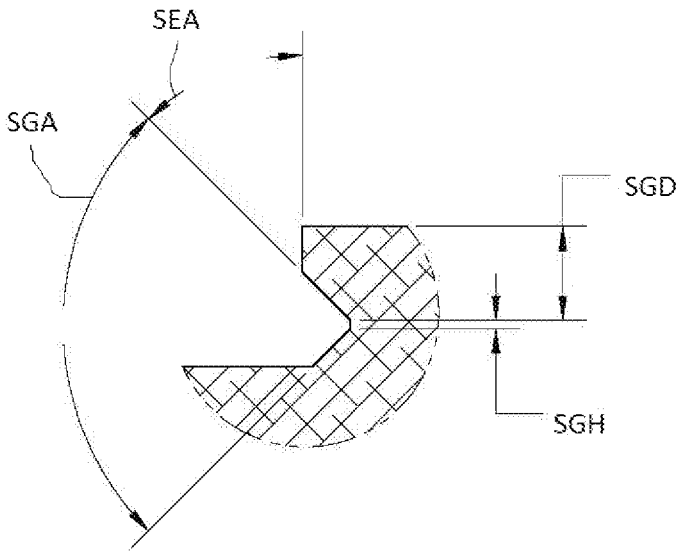
FIG. 33B is an enlarged view of detail area B of the gun lock for the rail riser of FIG. 33A, according to the fourth embodiment.

FIG. 33B is an enlarged view of detail area B of the gun lock for the rail riser of FIG. 33A, according to the fourth embodiment. The slot 2804 can have side grooves 3380 within the main channel groove, and the side grooves can secure the rail riser within the slot. Side grooves 3380 in slot 2804 function with regard to the elevated second rail of an inserted rail riser in the same manner that the side grooves (described above) of the rail riser function with respect to the rail of the weapon. The side grooves 3380 accommodate the insertion of top shoulders (described above) and prevent lateral rotation and movement of the rail riser when engaged in the slot 2804. When top shoulders are slid within the side grooves 3380, the engagement of the top shoulders within the grooves 3380 prevents the rail riser from being pulled out through the front face of the lock body. Side grooves 3380 can have a side groove angle SGA of approximately 90°. The lock body can have a side edge angle SEA between the side groove and the edge of the slot of approximately 45°. The side groove can have a minimum side groove height SGH of approximately 0.021 inch. The side groove can have a side groove depth SGD of approximately 0.245 inch.

It should be clear to one of ordinary skill that the above described gun mount, in the various embodiments herein, provides a highly robust, secure and effective system for securing a firearm that involves no moving parts and is adaptable as a holding device and/or a locking device.

The foregoing has been a detailed description of illustrative embodiments of the invention. Various modifications and additions can be made without departing from the spirit and scope of this invention. Features of each of the various embodiments described above may be combined with features of other described embodiments as appropriate in order to provide a multiplicity of feature combinations in associated new embodiments. Furthermore, while the foregoing describes a number of separate embodiments of the apparatus and method of the present invention, what has been described herein is merely illustrative of the application of the principles of the present invention. For example, the rifle as show above can be a shotgun or a handgun. It is expressly contemplated that the dimensions of the gun lock can be increased to accommodate larger weapons or weapons with a distinctive profile. The gun lock can be colored ad/or textured on it surfaces. The number of mounting holes can be greater than two. The gun lock can be rotated such that the slot is oriented to one side or another than towards the top. The profile shape of the gun lock can be octagonal, round or another shape (for example, a square). The gun lock can be bolted to a wall, glued to a wall, or a combination thereof. Additionally, as used herein various directional and dispositional terms such as "vertical", "horizontal", "up", "down", "bottom", "top", "side", "front", "rear", "left", "right", and the like, are used only as relative conventions and not as absolute directions/dispositions with respect to a fixed coordinate space, such as the acting direction of gravity. Additionally, where the term "substantially" or "approximately" is employed with respect to a given measurement, value or characteristic, it refers to a quantity that is within a normal operating range to achieve desired results, but that includes some variability due to inherent inaccuracy and error within the allowed tolerances of the system (e.g. 1-5 percent). Accordingly, this description is meant to be taken only by way of example, and not to otherwise limit the scope of this invention.

What is claimed is:

1. A gun lock system comprising:

a lock body, the lock body having a slot extending inward from an edge surface of the lock body along a front surface of the lock body, the slot having floor, a rear wall, and two sidewalls, the sidewalls having a side groove, and the lock body having a channel extending through the lock body and through the slot, the lock body defining a cable passage extending from a first side to a second side at a rear surface of the lock body.

2. The gun lock system of claim 1, the lock body further comprising at least one mounting bolt hole, the mounting bolt hole having a first opening on the rear wall of the slot and a second opening on a rear surface of the body.

3. The gun lock system of claim 1, wherein the sidewalls further comprise a shoulder extending along the sidewalls.

4. The gun lock system of claim 1, wherein the channel is sized and shaped to accommodate a shackle of a padlock.

5. The gun lock system of claim 1, further comprising a rail riser having an elevated rail, wherein the slot is sized and shaped to accommodate the elevated rail.

6. The gun lock system of claim 1, wherein the slot has an angled "V" portion at an opening at the edge surface.

7. The gun lock body system of claim 1, further comprising a first mounting bolt hole and a second mounting bolt wherein the first mounting bolt hole is positioned above the locking cable passage and the second mounting bolt hole is positioned below the locking cable passage.

8. A gun lock system comprising:

a rail riser having an elevated rail; and a lock body, the lock body having a slot extending inward from an edge surface of the lock body along a front surface of the lock body, the slot sized and shaped to accommodate the elevated rail, the slot having floor, a rear wall, and two sidewalls, the sidewalls having a side groove, and the lock body having a channel extending through the lock body and through the slot.

9. The gun lock system of claim 8, wherein a distance from the floor to the channel is at least as long as a length of the elevated rail.

10. The gun lock system of claim 8, wherein the channel is sized and shaped to accommodate a shackle of a padlock.

11. The gun lock system of claim 8, wherein when the elevated rail is within the slot and a shackle of a padlock is inserted through the channel, the shackle of the padlock retains the elevated rail within the slot.

12. The gun lock system of claim 11, further comprising the padlock.

13. The gun lock system of claim 8, wherein the lock body further comprises at least one mounting bolt hole, the mounting bolt hole having a first opening on a rear wall of the slot and a second opening on a rear surface of the body, wherein when the rail riser is within the slot, the rail riser covers the opening on the rear wall of the slot.

14. The gun lock system of claim 13, wherein a mounting bolt within the mounting bolt hole is inhibited from being removed when the elevated rail is within the slot.

15. The gun lock system of claim 8, wherein the rail riser further comprises at least one rail bolt hole through the rail riser, the rail bolt hole having an opening on the elevated rail of the rail riser, wherein when the elevated rail is within the slot, the lock body covers the opening on the elevated rail.

16. The gun lock system of claim 15, wherein when a rail bolt is within the rail bolt hole and securing the rail riser to a weapon, the rail bolt is inhibited from being removed when the elevated rail is within the slot.

17. The gun lock system of claim 8, wherein the sidewalls further comprise a shoulder extending along the sidewalls and wherein the slot has an angled "V" portion at an opening at the edge surface.

18. The gun lock system of claim 8, wherein the rail riser defines a central well, the central well having a retaining lip.

19. A method of securing a weapon having a weapon rail, the method comprising:

obtaining a rail riser having an elevated rail;

affixing the rail riser to the weapon rail;

obtaining a lock body, the lock body having a slot extending down from a top surface of the lock body along a front surface of the lock body, the slot having floor, a rear wall, and two sidewalls, the sidewalls having a side groove, and the lock body having a channel extending through the lock body and through the slot, and the lock body having at least one mounting bolt hole, the mounting bolt hole having a first opening on the rear wall of the slot and a second opening on a rear surface of the body;

securing the lock body to a wall by inserting a bolt through the mounting bolt hole and into a wall;

sliding the elevated rail into the slot, whereby the rail riser covers and protects the mounting bolt and inhibits removal of the mounting bolt so that the lock body cannot be unbolted from the wall;

obtaining a padlock with a shackle;

inserting the shackle through the channel so that the shackle is above the elevated rail and inhibits the elevated rail from sliding out of the slot; and locking the padlock, thereby inhibiting the rail riser from being removed from the slot.

20. The method of securing a weapon having a weapon rail of claim 19, further comprising securing the rail riser to the rail of the weapon by inserting a bolt through an opening on the elevated rail and through a rail bolt hole of the rail riser and into a space between segments of the weapon rail.

* * * * *